US009212412B2

(12) United States Patent
Oikawa et al.

(10) Patent No.: US 9,212,412 B2
(45) Date of Patent: Dec. 15, 2015

(54) LEAN DUPLEX STAINLESS STEEL EXCELLENT IN CORROSION RESISTANCE AND TOUGHNESS OF WELD HEAT AFFECTED ZONE

(75) Inventors: Yuusuke Oikawa, Tokyo (JP); Hiroshi Urashima, Tokyo (JP); Shinji Tsuge, Tokyo (JP); Hiroshige Inoue, Tokyo (JP); Ryo Matsuhashi, Tokyo (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 521 days.

(21) Appl. No.: 12/736,255

(22) PCT Filed: Mar. 26, 2009

(86) PCT No.: PCT/JP2009/056840

§ 371 (c)(1),
(2), (4) Date: Dec. 7, 2010

(87) PCT Pub. No.: WO2009/119895

PCT Pub. Date: Oct. 1, 2009

(65) Prior Publication Data

US 2011/0097234 A1 Apr. 28, 2011

(30) Foreign Application Priority Data

Mar. 26, 2008 (JP) ..... 2008-081862
Feb. 26, 2009 (JP) ..... 2009-044046

(51) Int. Cl.
*C22C 38/42* (2006.01)
*C22C 38/00* (2006.01)
(Continued)

(52) U.S. Cl.
CPC ..... *C22C 38/42* (2013.01); *C22C 38/001* (2013.01); *C22C 38/02* (2013.01); *C22C 38/06* (2013.01); *C22C 38/46* (2013.01); *C22C 38/58* (2013.01)

(58) Field of Classification Search
CPC ..... C22C 38/42
USPC ..... 148/325–327; 420/34, 36–41, 56–61, 420/65–69
See application file for complete search history.

(56) References Cited

U.S. PATENT DOCUMENTS 4,798,635 A 1/1989 Bernhardsson et al.
5,672,215 A * 9/1997 Azuma et al. ..... 148/325
(Continued)

FOREIGN PATENT DOCUMENTS

JP 61-56267 3/1986
JP 11-080901 3/1999
(Continued)

OTHER PUBLICATIONS

International Search Report dated Jul. 21, 2009 issued in corresponding PCT Application No. PCT/JP2009/056840.
(Continued)

*Primary Examiner* — Brian Walck
(74) *Attorney, Agent, or Firm* — Kenyon & Kenyon LLP

(57) ABSTRACT

The present invention provides a lean duplex stainless steel able to suppress the drop in corrosion resistance and toughness of a weld heat affected zone comprising, by mass %, C: 0.06% or less, Si: 0.1 to 1.5%, Mn: 2.0 to 4.0%, P: 0.05% or less, S: 0.005% or less, Cr: 19.0 to 23.0%, Ni: 1.0 to 4.0%, Mo: 1.0% or less, Cu: 0.1 to 3.0%, V: 0.05 to 0.5%, Al: 0.003 to 0.050%, O: 0.007% or less, N: 0.10 to 0.25%, and Ti: 0.05% or less, having a balance of Fe and unavoidable impurities. An Md30 value is 80 or less, an Ni-bal is −7.1 to 4, an austenite phase area percentage is 40 to 70%, and a 2×Ni+Cu is 3.5 or more: Md30=551−462×(C+N)−9.2×Si−8.1×Mn−29×(Ni+Cu)−13.7×Cr−18.5×Mo−68×Nb; Ni-bal=(Ni+0.5Mn+0.5Cu+30C+30N)−1.1(Cr+1.5Si+Mo+W)+8.2 and N(%)≤0.37+0.03×(Ni-bal).

43 Claims, 1 Drawing Sheet

(51) Int. Cl.

| | |
|---|---|
| ***C22C 38/02*** | (2006.01) |
| ***C22C 38/06*** | (2006.01) |
| ***C22C 38/46*** | (2006.01) |
| ***C22C 38/58*** | (2006.01) |

(56) References Cited

U.S. PATENT DOCUMENTS

| | | | | |
|---|---|---|---|---|
| 2007/0163679 | A1 * | 7/2007 | Fujisawa et al. ..... | 148/325 |
| 2009/0098007 | A1 | 4/2009 | Tsuge et al. | |

FOREIGN PATENT DOCUMENTS

| | | | |
|---|---|---|---|
| JP | 2006-183129 | | 7/2006 |
| JP | 2006-233308 | | 9/2006 |
| JP | 2007-084841 | | 4/2007 |
| JP | 2008-038214 | | 2/2008 |
| WO | WO 96/18751 | | 6/1996 |
| WO | WO 02/27056 | | 4/2002 |
| WO | WO 2008/018242 | A1 | 2/2008 |

OTHER PUBLICATIONS

"Tetsu-to-Hagane," The Journal of the Iron and Steel Institute of Japan, vol. 63 (1977), No. 5, p. 772-782 and cover.

"Recommended Equilibrium Value of Steel making Reactions," The Japan Society of promotion of Science, Steel making No. 19 Committee ed., Nov. 1, 1984 p. 258-259, cover and content.

Chinese Office Action dated Dec. 23, 2011, issued in the corresponding Chinese Application.

* cited by examiner

LEAN DUPLEX STAINLESS STEEL EXCELLENT IN CORROSION RESISTANCE AND TOUGHNESS OF WELD HEAT AFFECTED ZONE

This application is a national stage application of International Application No. PCT/JP2009/056840, filed 26 Mar. 2009, which claims priority to Japanese Application Nos. 2008-081862, filed 26 Mar. 2008; and 2009-044046, filed 26 Feb. 2009, each of which is incorporated by reference in its entirety.

TECHNICAL FIELD

The present invention relates to a lean duplex stainless steel keeping down the contents of Ni, Mo, and other expensive alloy elements in duplex stainless steel including two phases, an austenite phase and a ferrite phase, wherein one of the big problems at the time of use, that is, the drop in corrosion resistance and toughness of a weld heat affected zone, is reduced and thereby the work efficiency of welding, which can become a bottleneck in application of that steel to welded structures, can be improved.

BACKGROUND ART

Duplex stainless steel has the two phases, an austenite phase and a ferrite phase, in the micro-structure of the steel and has been used as a high strength, high corrosion resistance material since the past for materials for petrochemical facilities, materials for pumps, materials for chemical tanks, etc. Further, duplex phase stainless steel is generally made of a composition with low Ni, so along with the recent skyrocketing price of metal raw materials, it is being closely looked at as a material with a lower and less fluctuating alloy cost compared with an austenitic stainless steel that is the mainstream of stainless steel.

As recent topics in duplex stainless steel, there are the development of lean types and their increased amount of usage. A "lean type" is a type of steel in which the content of expensive alloy elements is kept down compared with the conventional duplex stainless steels and the merit of low alloy cost is further enhanced. This is disclosed in Japanese Patent Publication (A) No. 61-56267, WO2002/27056, and WO96/18751. Among these, the duplex stainless steels disclosed in Japanese Patent Publication (A) No. 61-56267 and WO2002/27056 have been standardized in ASTM-A240. The former corresponds to S32304 (typical composition 23Cr-4Ni-0.17N), while the latter corresponds to S32101 (typical composition 22Cr-1.5Ni-5Mn-0.22N). The main types of steel in conventional duplex stainless steel were JIS SUS329J3L and SUS329J4L, but these are further higher in corrosion resistance than the SUS316L that is relatively high corrosion resistance type of an austenitic stainless steel and have expensive Ni and Mo added to about 6 to 7% (below, in the present invention, the % of the ingredients expressing mass %) and about 3 to 4% added to them respectively. As opposed to this, the lean duplex stainless steel is designed for a corrosion resistance of a level close to SUS316L or the general use steel SUS304, but instead makes the amount of addition of Mo substantially 0 and greatly reduces the addition of Ni to about 4% in S32304 and about 1% in S32101.

The duplex stainless steel described in Japanese Patent Publication (A) No. 2006-183129 is an improved version of the duplex stainless steel S32304 described in Japanese Patent Publication (A) No. 61-56267 in which the corrosion resistance in an acidic environment is raised by adding Cu and the strength is raised by adding any of Nb, V, and Ti. Further, Japanese Patent Publication (A) No. 2006-183129 prescribes a type of ingredients of a lean duplex steel as an austenitic/ferritic stainless steel superior in ductility and deep drawability in which, as a selective element, 0.5% or less of V is added and in which, as an effect, the micro-structure of the steel is refined and the strength is raised.

DISCLOSURE OF INVENTION

Among these duplex stainless steels, in particular in steel of the S32101 level greatly reduced in Ni and Mo (Ni: 2% or less), what becomes a problem is the drop in corrosion resistance and toughness of the weld heat affected zone.

Regarding the corrosion resistance, the lean type is inherently inferior to conventional type duplex stainless steels in corrosion resistance, but is designed for a level close to SUS304 or SUS316L and has a corrosion resistance no different from SUS304 and SUS316L after solubilization heat treatment and in the state with no welding. In this regard, in particular in the case of the lean type, at the time of welding, when the heat affected zone near the weld zone (so-called HAZ) receives a certain limit or more of input heat, an extreme drop in corrosion resistance is caused and once in a while the corrosion resistance is below the level of SUS304.

Regarding the toughness, a duplex stainless steel has an austenite phase usually considered not to cause embrittlement fracture and a ferrite phase with the possibility of embrittlement fracture, so inherently is inferior in toughness compared with an austenitic stainless steel. However, so long as there is no involvement of the intermetallic compounds etc. such as the sigma phase, usually a sudden ductility-embrittlement transfer like in ferritic stainless steel does not occur. This has a sufficient level of toughness as a constructual material so long as not being used at a considerably low temperature.

However, in the same way as corrosion resistance, at the HAZ, the toughness falls, and sometimes the toughness becomes a level hard to use for structural applications so to avoid fracture due to stress.

Due to the above reasons, despite the S32101 level of lean duplex stainless steel having a considerably cheaper alloy cost, the steel is used only for applications where the corrosion resistance and toughness are not too much problems or the steel is used with a low heat input, that is, with the weld speed lowered in welding. There are many problems for broad use in place of austenitic stainless steel. With the S32304 at which the steel disclosed in Japanese Patent Publication (A) No. 61-56267 is standardized, such a problem is almost never seen, but this contains about 4% of Ni and is relatively expensive. Japanese Patent Publication (A) No. 61-56267 describes "Ni: 2 to 5.5%", that is, the Ni content can be reduced to 2%, but if actually lowering it to 2%, the above drop in toughness occurs. The same is true for the steel described in WO96/18751.

The object of the present invention is the provision of a lean type of duplex stainless steel which greatly keeps down the alloy cost, then suppresses the above-mentioned drop in corrosion resistance and toughness of the HAZ and reduces the problems occurring at the time of use for a constructual material etc.

The inventors studied in detail the methods for reducing as much as possible the above drop in corrosion resistance and toughness of the HAZ and as a result obtained findings regarding the mechanism of occurrence of this phenomenon and means for its reduction and thereby arrived at the present invention.

The reason why the corrosion resistance and toughness fall at the weld HAZ is as follows. The N added to the duplex stainless steel almost completely forms a solid solution in the austenite phase, and a very small amount forms a solid solution in the ferrite phase. Due to the heating at the time of welding, the ratio of the ferrite phase increases and the austenite phase decreases. The amount of solute N in the ferrite increases, but at the time of cooling after welding, the cooling rate is fast, so the austenite phase does not return to the amount of before welding while the amount of solute N in the ferrite phase remains at a higher level compared with before welding. The solubility limit of N in the ferrite phase is relatively small, so the amount exceeding the solubility limit at the time of cooling forms chromium nitrides and precipitates. These nitrides promote crack propagation and thereby lower the toughness. Further, due to the precipitation, the chromium is consumed and a so-called chromium depleted zone is formed whereby the corrosion resistance is lowered.

Normally, as the technique for reducing the amounts of solute C and N in the ferrite phase, alloying with "Ti and Nb" and other such carbonitride-stabilizing elements is widely known. In ferrite stainless steels, high purity ferrite stainless steels reducing the contents of C and N to ultra low levels and adding about 0.1 to 0.6% of Ti and Nb have been commercialized. In this regard, if alloying such amounts of Ti and Nb with a lean duplex stainless steel containing a large amount of N, this N will precipitate in large amounts as nitrides and will impair the toughness. The inventors considered the actions of V, Nb, B, and other elements having affinity with N, investigated and researched the relationship between their content and the corrosion resistance and toughness of the weld HAZ in lean duplex stainless steels, and thereby obtained the following discoveries:

In the lean duplex stainless steel of the present invention, V, Nb, B, and other elements have different magnitudes of affinity with N. The temperature ranges where their nitrides are generated differ depending on the types and amounts of the elements. Ti, Zr, and other such elements with extremely strong affinities end up forming nitrides and precipitating at the considerably high temperature around the solidification point, while B with a relatively strong affinity ends up forming nitrides and precipitating near the temperature of the hot rolling or solubilization heat treatment. These are believed to cause a drop in toughness. On the other hand, V and Nb, by adjustment of content, were expected to enable adjustment of the solid solution/precipitation in the 900 to 600° C. temperature range where chromium nitrides are formed. Therefore, the inventors proceeded to study means for improvement using addition of V. As described in the above-mentioned literature, there are previous examples of addition of V to duplex stainless steel, but the usual addition of V was for improving the strength or, in the same way as the above-mentioned Ti and Nb, for causing solute N to precipitate as much as possible as V nitrides and suppressing the precipitation as chromium nitrides so as to suppress the formation of a chromium depleted zone, that is, for so-called stabilization. V is usually added in a level for causing precipitation of V nitrides. As opposed to this, in the present invention, based on the following thinking, the point is to keep the addition of V to the solute level so as to thereby suppress the precipitation of nitrides at the HAZ.

The mechanism is as follows: chromium nitrides precipitate at the time of cooling after heating due to welding by the HAZ being exposed to the 500 to 900° C. or so nitride-precipitation temperature range for a short time, several seconds to several tens of seconds. The affinity of V with N is lower than those of Ti, Nb, etc., but higher than that of Cr. To lower the activity of N, addition of a fine amount of V retards the precipitation of chromium nitrides and therefore can keep down the amount of precipitation of chromium nitrides in the short time of tens of seconds. On the other hand, if adding a large amount like in the conventional method, the corrosion resistance is improved, but the toughness falls in the same way as conventional steel since a large amount of V nitrides precipitate.

To obtain the above effects of V addition, V has to be made the solid solution state. For this, it is necessary to make the so-called solubility product [V]×[N] no more than a constant value. Due to this, in addition to suppressing the excess addition of V, it is possible to allow a relatively large amount of addition of V by suppressing as much as possible the amount of N in the ferrite. In the case of duplex steel, N addition contributes to improvement of the corrosion resistance, increase of the ratio of the austenite phase, etc., so to control the amount of N in the ferrite, it is necessary not just to keep down the amount of N, but to combine control of the amount of ferrite and control of the amount of N addition corresponding to the amount of ferrite. The amount of N in the ferrite phase can be reduced not only by lowering the content of N in the steel, but also by raising the ratio of the austenite. The reason is that the austenite phase is larger in solute amount of N than the ferrite phase. Therefore, in the sense of controlling the ratio of so-called austenite stabilizing elements and ferrite stabilizing elements, the Ni-bal widely used as a formula for estimating the amount of austenite was applied. Further, the upper limit of the amount of addition of N enabling the effects of addition of V to be exhibited was defined in accordance with the different levels of the Ni-bal. By this, it was possible to provide duplex stainless steel having large effects in combination with addition of V.

Note that, to further improve the toughness of the HAZ, it is effective, in addition to keeping down the precipitation of nitrides, to improve the toughness itself of the base material. From this viewpoint, addition of a level of Ni and Cu allowable in terms of alloy cost is effective. Ni and Cu are main austenite stabilizing elements. Further, their addition enables the toughness of the ferrite phase to be improved. In duplex stainless steel, cracks propagate at the ferrite phase, so addition of Ni and Cu is extremely effective for improvement of the toughness. Even if a certain extent of precipitation of nitrides occurs due to the improvement of the toughness of the ferrite phase, the drop in toughness will not reach the critical level for structural applications, that is, will not reach the level of embrittlement fracture at the room temperature level.

From these results, we invented a lean duplex stainless steel which has a chemical composition which incorporates these effects and, furthermore, can solve the above problems by suitable determination of the ingredients.

Further, the inventors investigated techniques for judging the quality of the corrosion resistance and toughness of the HAZ of steel and discovered the following method of evaluation, that is subjecting a steel sample in order to (i) temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. by spraying nitrogen etc. until room temperature, that is, giving the heat pattern such as in FIG. 1 to the steel, and analyzing the steel sample by the extract residues.

This heat pattern is a simplified simulation of the heat cycle of the welding generally used with stainless steel. The highest temperature region of (ii) generally corresponds to the region of increase of the ferrite phase that has the small nitrogen solubility limit, the medium extent temperature region of (iii) to the region of transformation of part of the ferrite phase to the austenite phase, and the low temperature region of (iv) to the region of precipitation of chromium nitrides. The respective passage times were prepared based on actual temperature measurement data. That is, using the heat pattern, it is possible to simulate conditions enabling easy precipitation of chromium nitrides at the time of actual welding. By analyzing the extract residues of the duplex stainless steel material after the above heat treatment, it is possible to estimate the amounts of precipitates in the weld zone of the steel material. Note that, in the steel material, almost all of the precipitates are carbonitrides.

In summary, the gist of the present invention is as follows:

(1) A lean duplex stainless steel excellent in corrosion resistance and toughness of a weld heat affected zone containing, by mass %, C: 0.06% or less, Si: 0.1 to 1.5%, Mn: 2.0 to 4.0%, P: 0.05% or less, S: 0.005% or less, Cr: 19.0 to 23.0%, Ni: 1.0 to 4.0%, Mo: 1.0% or less, Cu: 0.1 to 3.0%, V: 0.05 to 0.5%, Al: 0.003 to 0.050%, O: 0.007% or less, N: 0.10 to 0.25%, and Ti: 0.05% or less and having a balance of Fe and unavoidable impurities, wherein having an Md30 value expressed by formula <1> of 80 or less, having an Ni-bal expressed by formula <2> of −8 to −4, having a relationship between the Ni-bal and the N content satisfying formula <3>, having an austenite phase area percentage of 40 to 70%, and having a 2×Ni+Cu of 3.5 or more:

$$Md30=551-462\times(C+N)-9.2\times Si-8.1\times Mn-29\times(Ni+Cu)-13.7\times Cr-18.5\times Mo-68\times Nb \quad <1>$$

$$Ni\text{-}bal=(Ni+0.5Mn+0.5Cu+30C+30N)-1.1(Cr+1.5Si+Mo+W)+8.2 \quad <2>$$

$$N(\%)\leq 0.37+0.03\times(Ni\text{-}bal) \quad <3>$$

where, in the above formulas, the element names all express their content (%).

(2) A lean duplex stainless steel excellent in corrosion resistance and toughness of a weld heat affected zone comprised of the duplex stainless steel as set forth in (1), further containing, by mass %, Nb: 0.02 to 0.15% and satisfying Nb×N of 0.003 to 0.015, where Nb and N show the mass % of their respective contents.

(3) A lean duplex stainless steel excellent in corrosion resistance and toughness of a weld heat affected zone comprised of the duplex stainless steel as set forth in (1), further containing, by mass %, one or more types of elements of Ca≤0.0050%, Mg≤0.0050%, REM: ≤0.050%, and B≤0.0040%.

(4) A lean duplex stainless steel excellent in corrosion resistance and toughness of a weld heat affected zone comprised of the duplex stainless steel as set forth in (1), further containing, by mass %, Nb: 0.02 to 0.15% and satisfying Nb×N of 0.003 to 0.015, where Nb and N show the mass % of their respective contents, and further containing, by mass %, one or more types of elements of Ca≤0.0050%, Mg≤0.0050%, REM: ≤0.050%, and B≤0.0040%.

(5) A lean duplex stainless steel excellent in corrosion resistance and toughness of a weld heat affected zone comprised of the duplex stainless steel as set forth in (1), further containing, by mass %, Co: 0.02 to 1.00%.

(6) A lean duplex stainless steel excellent in corrosion resistance and toughness of a weld heat affected zone comprised of the duplex stainless steel as set forth in (1), further containing, by mass %, Nb: 0.02 to 0.15% and satisfying Nb×N of 0.003 to 0.015, where Nb and N show the mass % of their respective contents, and further containing, by mass %, Co: 0.02 to 1.00%.

(7) A lean duplex stainless steel excellent in corrosion resistance and toughness of a weld heat affected zone comprised of the duplex stainless steel as set forth in (1), further containing, by mass %, Nb: 0.02 to 0.15% and satisfying Nb×N of 0.003 to 0.015, where Nb and N show the mass % of their respective contents, further containing, by mass %, one or more types of elements of Ca≤0.0050%, Mg≤0.0050%, REM: ≤0.050%, and B≤0.0040%, and further containing, by mass %, Co: 0.02 to 1.00%.

(8) A lean duplex stainless steel excellent in corrosion resistance and toughness of a weld heat affected zone comprised of the duplex stainless steel as set forth in (1), further containing, by mass %, Mg: 0.0001 to 0.0050%, having a product of $f_N$, Ti content, and N content, that is, $f_N$×Ti×N, of 0.00004 or more, and having a product of Ti content and N content, that is, Ti×N, of 0.008 or less:

where, $f_N$ is a value satisfying the formula <4>:

$$\log_{10} f_N=-0.046\times Cr-0.02\times Mn-0.011\times Mo+0.048\times Si+0.007\times Ni+0.009\times Cu \quad <4>$$

where, in the above formula, the element names all express content (mass %).

(9) A lean duplex stainless steel excellent in corrosion resistance and toughness of a weld heat affected zone comprised of the duplex stainless steel as set forth in (1), further containing, by mass %, one or more types of elements of Zr≤0.03%, Ta≤0.1%, W≤1.0%, and Sn≤0.1%.

(10) A lean duplex stainless steel excellent in corrosion resistance and toughness of a weld heat affected zone comprised of the duplex stainless steel as set forth in any one of (1) to (9), wherein an amount of extract residue of Cr of the steel after heat treatment of the following (i) to (v) simulating a heat history received by the steel at the time of welding is 0.025% or less and a CRN value shown in the following formula <5> is 0.5 or more:

(i) temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature.

$$CRN=([Cr]/104)/\{([Cr]/104)+([V]/51)+([Nb]/93)+([B]/11)\} \quad <5>$$

where, [Cr], [V], [Nb], and [B] all express amounts of extract residues (mass %) of the elements.

In the lean duplex stainless steel as set forth in (1) of the present invention, it is possible to provide a lean type duplex stainless steel with lower alloy cost and less cost fluctuation than an austenitic stainless steel wherein one of the major problems, that is, the drop in the corrosion resistance and toughness of a weld heat affected zone, can be suppressed and as a result expansion into applications taking the place of austenitic stainless steel where the work efficiency of welding had been an issue can be promoted. The contribution to industry is extremely great.

In the lean duplex stainless steel as set forth in (2) of the present invention, due to the addition of a fine amount of Nb, the drop in corrosion resistance and toughness of the weld heat affected zone due to precipitation of nitrides can be further suppressed.

In the lean duplex stainless steels as set forth in (3) and (4) of the present invention, it is possible to suppress the drop in the corrosion resistance and toughness of the weld heat affected zone of the steels while improving the hot workability.

In the lean duplex stainless steels as set forth in (5) and (6) of the present invention, it is possible to suppress the drop in the corrosion resistance and toughness of the weld heat affected zone of the steels and, in the lean duplex stainless steel as set forth in (7), it is possible to further secure hot workability, while further improving the toughness and corrosion resistance of the steels.

In the lean duplex stainless steel as set forth in (8) of the present invention, it is possible to suppress the drop in the corrosion resistance and toughness of a weld heat affected zone of the steel while, by the composite addition of Ti and Mg, refining the ferrite structure and further improving the toughness, while in the lean duplex stainless steel as set forth in (9) of the present invention, it is possible to suppress the drop in corrosion resistance and toughness of a weld heat affected zone of the steel while further improving the corrosion resistance. Further, in the lean duplex stainless steel as set forth in (10) of the present invention, the criteria for judgment when measuring the amounts of extract residues after applying specific heat treatment to a test material are prescribed and evaluation enabling clarification of a material as suppressed in drop in corrosion resistance and toughness of a weld heat affected zone is provided.

BEST MODE FOR CARRYING OUT THE INVENTION

Figure 1:
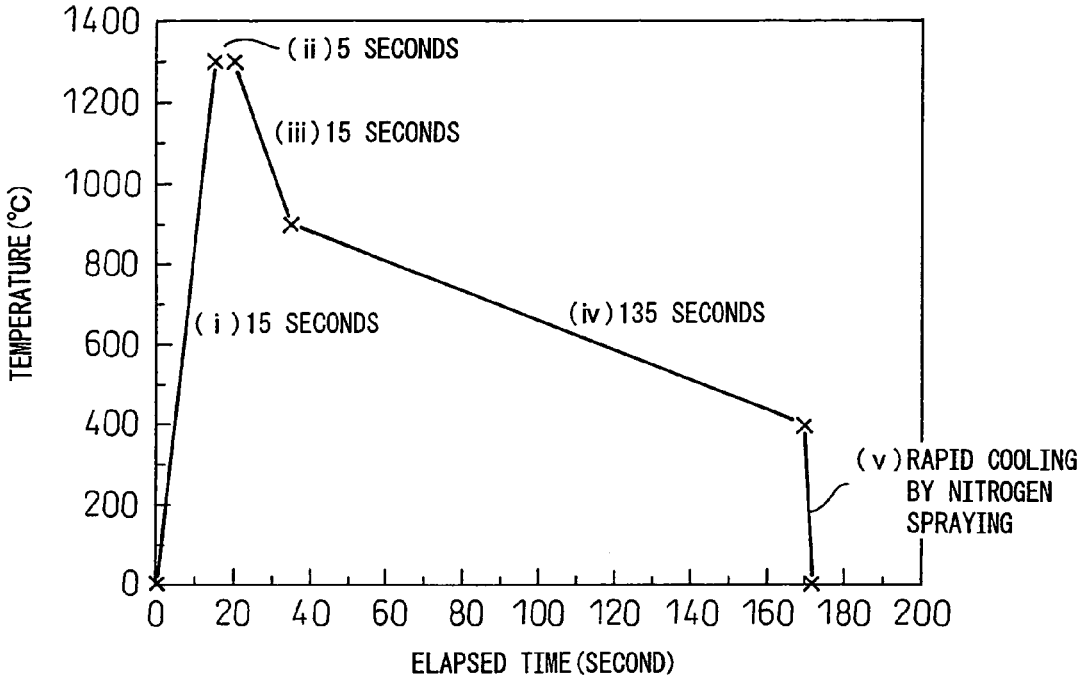
FIG. 1 is a view showing a heat pattern of heat treatment simulating a weld heat cycle in the present invention.

Below, the present invention will be explained in detail.

First, the reasons for limitation of the steel composition of the lean duplex stainless steel as set forth in (1) of the present invention will be explained. Note that, the % in the ingredients mean mass %.

C is limited to a content of 0.06% or less to secure the corrosion resistance of the stainless steel. If over 0.06% is included, chromium carbides are formed and the corrosion resistance deteriorates. Preferably, the content is 0.04% or less. On the other hand, extremely greatly reducing the content would greatly raise the cost, so preferably the lower limit is made 0.001%.

Si is added in an amount of 0.1% or more for deoxidation. However, if over 1.5% is added, the toughness deteriorates. For this reason, the upper limit is made 1.5%. The preferable range is 0.2 to less than 1.0%.

Mn increases the austenite phase in a duplex stainless steel and suppresses the formation of deformation-induced martensite and improves the toughness. Further, it raises the solubility of nitrogen and suppresses the precipitation of nitrides in the weld zone, so 2.0% or more is added. However, if over 4.0% is added, the corrosion resistance deteriorates. For this reason, the upper limit is made 4.0%. The preferable range is over 2.0 to less than 3.0%.

P is an element unavoidably included in steel. It degrades the hot workability, so is limited to 0.05% or less. Preferably, the content is 0.03% or less. On the other hand, greatly reducing the content leads to a great increase in costs, so preferably the lower limit is made 0.005%.

S is like P an element unavoidably included in steel. It degrades the hot workability and the toughness and corrosion resistance as well, so is limited to 0.005% or less. Preferably, the content is 0.002% or less. On the other hand, greatly reducing the content leads to a great increase in costs, so preferably the lower limit is made 0.0001%.

Cr is an element basically required for keeping corrosion resistance. On top of this, it is also effective in suppressing the formation of deformation-induced martensite. It is a relatively inexpensive alloy element, so in the present invention is included in an amount of 19.0% or more. On the other hand, it is an element increasing the ferrite phase. If over 23.0% is included, the amount of ferrite becomes excessive and the corrosion resistance and toughness are impaired. For this reason, the content of Cr is made 19.0% to 23.0%.

Ni is an element effective for increasing the austenite phase in duplex stainless steel, suppressing the formation of deformation-induced martensite and improving the toughness, and furthermore improving the corrosion resistance against various types of acids. 1.0% or more is added, but this is an expensive alloy element, so in the present invention, the content is suppressed as much as possible and made 4.0% or less. The preferable range is 1.50 to less than 3%.

Mo is an element extremely effective for additionally raising the corrosion resistance of the stainless steel. It is an extremely expensive element, so in the present invention, the content is suppressed as much as possible and the upper limit is defined as 1.0% or less. The preferable range is 0.1 to less than 0.5%.

Cu, like Ni, is an element effective for increasing the austenite phase in duplex stainless steel, suppressing the formation of deformation-induced martensite and improving the toughness, and furthermore improving the corrosion resistance against various types of acids. Further, it is an inexpensive alloy element compared with Ni, so in the present invention, 0.1% or more is added. If over 3.0% is included, the hot workability is impaired, so the upper limit is made 3.0%. The preferable range is over 1.0% to 2.0%.

V is an important additive element in the present invention. As explained above, it lowers the activity of N and delays the precipitation of nitrides. For this, 0.05% or more has to be added. On the other hand, if over 0.5% is added, V nitrides precipitate whereby the HAZ toughness is lowered, so the upper limit is made 1.0%. The preferable range is 0.06% to 0.30%.

Al is an important element for deoxidation of steel. To reduce the oxygen in the steel, 0.003% or more must be added. On the other hand, Al is an element with a relatively large affinity with N. If excessively added, AlN forms and impairs the toughness of the base material. The extent depends also on the N content, but if the Al content exceeds 0.050%, the toughness falls remarkably, so the upper limit of the content is set at 0.050%. Preferably, the content is 0.030% or less.

O is a harmful element which forms oxides—typical examples of non-metal inclusions. Excessive content impairs the toughness. Further, if coarse cluster-like oxides are formed, they become causes of surface cracks.

For this reason, the upper limit of the content is set at 0.007%. Preferably, the content is 0.005% or less. On the other hand, extreme reduction of the content would lead to a great increase in costs, so the lower limit is preferably made 0.0005%.

N is an effective element forming a solid solution in an austenite phase to raise the strength and corrosion resistance and increasing the austenite phase in the duplex stainless steel. For this reason, 0.10% or more is included. On the other hand, if over 0.25% is included, chromium nitrides precipitate at the weld heat affected zone to impair the toughness, so the upper limit of the content is made 0.25%. Preferably, the content is 0.10 to 0.20%. The upper limit of N furthermore, as explained later, is defined in relation to the Ni-bal.

Ti, as explained above, precipitates as a nitride and impairs the toughness even with addition of a very small amount, so is reduced as much as possible. If over 0.05%, even with the smallest N content, coarse TiN will be formed and impair the toughness, so the content is limited to 0.05% or less.

Next, the Md30 of the following formula <1> is a formula generally known as a composition showing the degree of work hardening by deformation-induced martensite in austenitic stainless steel and is described in "Tetsu-to-Hagane", Vol. 63, No. 5, p. 772 etc. In general, the smaller the amount of addition of alloy elements, the higher the Md30 and the easier work hardening. The present invention steel is a duplex stainless steel, but is a lean type, so the austenite phase is believed to be more susceptible to work hardening than the conventional duplex stainless steel. The inventors discovered that in a material of ingredients with a large work hardening degree, the toughness of the base material falls and use the Md30 to define the upper limit of the work hardening degree. Specifically, it is possible to obtain a good toughness with Md30≤80.

$$Md30=551-462\times(C+N)-9.2\times Si-8.1\times Mn-29\times(Ni+Cu)-13.7\times Cr-18.5\times Mo-68\times Nb \quad <1>$$

Further, in the duplex stainless steel of the present invention, to obtain good characteristics, it is necessary to make the austenite phase area percentage 40 to 70% in range. If less than 40%, the toughness is poor, while if over 70%, problems appear in hot workability and stress corrosion cracking. Further, in both cases, the corrosion resistance becomes poor. In particular, in the present invention steels, to greatly reduce the drop in corrosion resistance and toughness due to precipitation of nitrides, it is better to increase the austenite phase, with its high solubility limit of nitrogen, as much as possible. If performing solubilization heat treatment under normal conditions in duplex stainless steel, that is, near 1050° C., the ratios of contents of the austenite phase stabilizing elements (Ni, Cu, Mn, C, N, etc.) and the ferrite phase stabilizing elements (Cr, Si, Mo, W, etc.) are adjusted in the prescribed ranges of the present invention to secure the above amount of austenite. Specifically the Ni-bal shown in the following formula <2> is made −8 to −4 in range. Preferably, the value is made −7.1 to −4.

$$Ni\text{-}bal=(Ni+0.5Cu+0.5Mn+30C+30N)-1.1(Cr+1.5Si+Mo+W)+8.2 \quad <2>$$

Further, as explained above, in the present invention, to make the addition of V effective, an upper limit is set for the amount of N corresponding to the Ni-bal. Regarding this upper limit, hot rolled duplex stainless steel plates of various compositions were fabricated in the laboratory and were subjected to solubilization heat treatment under the usual temperature condition of duplex stainless steels, that is, 1050° C. These steel plates were actually welded to evaluate the characteristics of the HAZs. As a result, as shown in FIG. 2, it was learned that good characteristics can be obtained by suppressing N to the range shown by the following formula <3>.

$$N(\%)\leq 0.37+0.03\times(Ni\text{-}bal) \quad <3>$$

Figure 2:
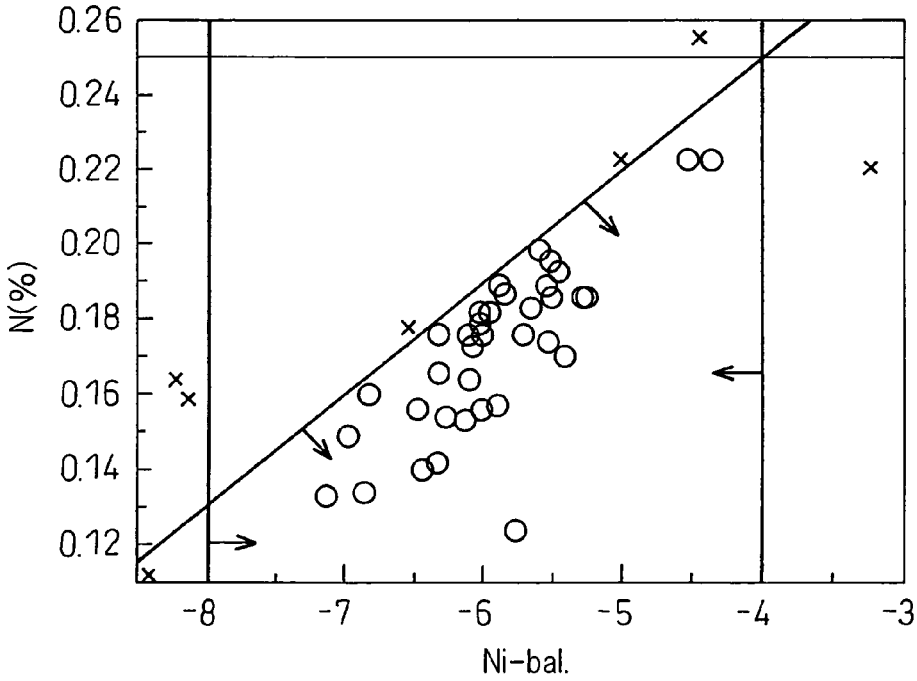
FIG. 2 is a view showing ranges of the Ni-bal and N giving a good corrosion resistance of the HAZ in the present invention.

Note that, the compositions of ingredients of the hot rolled duplex stainless steel sheet samples corresponding to the plots in FIG. 2 were the ranges of C: 0.011 to 0.047%, Si: 0.13 to 1.21%, Mn: 2.08 to 3.33%, P≤0.035%, S≤0.0025%, Ni: 1.24 to 3.66%, Cr: 19.53 to 22.33%, Mo: 0.07 to 0.71%, V: 0.055 to 0.444%, Al: 0.008 to 0.036%, and N: 0.111 to 0.222%.

Further, to improve the toughness of the HAZ, it is effective to add Ni and Cu, which are main austenite stabilizing elements and further can increase the toughness of the ferrite phase, at the level allowed in terms of the alloy cost. The inventors investigated the effects of Ni and Cu and as a result discovered that the contributions of the two elements to the effect of improvement of toughness can be expressed by 2Ni+Cu. That is, if making 2Ni+Cu 3.5 or more, even if performing submerged arc welding (heat input 3.5 kJ/mm) with a relatively large input heat and with remarkable heating of the HAZ, an absorption energy at −20° C. of 47J (based on JIS G3106 "Rolled Steel Materials for Welded Structures") or more, which is not a problem in usual structural applications, which convert to an impact value (since a full sized Charpy test piece has a cross-sectional area of 0.8 $cm^2$) of 58.75 $J/cm^2$ or more, can be achieved.

Next, the reasons for limitation of the lean duplex stainless steel as set forth in (2) of the present invention will be explained. The lean duplex stainless steel as set forth in (2) of the present invention further contains Nb.

Regarding Nb, as explained above, this is an element effective for lowering the activity of N and suppressing precipitation of nitrides. However, caution is required in addition since it has a relatively high affinity with N and even in a small amount of addition ends up causing precipitation of Nb nitrides. Therefore, by restricting the amount of addition of Nb to not more than an upper limit found by the relationship with N so as to be added in not more than the solubility limit, the effects of V can be further reinforced.

To obtain this effect, Nb has to be added in an amount of 0.02% or more. However, if excessively added, Nb nitrides precipitate and impair the toughness, including that of the base material, so the amount must be 0.15% or less. Furthermore, in the formula for finding the product of the Nb content and N content Nb×N, the so-called solubility product, by setting this value to 0.003 to 0.015, the range of addition of Nb makes possible to obtain the effects shown above and not having a detrimental effect on the toughness.

Next, the reasons for limitation of the steel composition of the lean duplex stainless steel as set forth in (3) of the present invention will be explained. The lean duplex stainless steel as set forth in (3) of the present invention further contains at least one of Ca, Mg, REM, and B.

Ca, Mg, REM, and B are all elements for improving the hot workability of the steel. For that purpose, one or more are added. In each case, excessive addition would conversely cause the hot workability to fall, so upper limits of contents are set as follows: for Ca and Mg, 0.0050%, while for REM, 0.050%. Here, "REM" is the sum of the contents of the La, Ce, and other lanthanide type rare earth elements. Note that, for Ca and Mg, stable effects are obtained from 0.0005%, so the preferable range is 0.0005 to 0.0050%, while for REM, stable effects are obtained from 0.005%, so the preferable range is 0.005 to 0.050%.

B is preferably added in an amount of 0.0003% or more so as to stably raise the grain boundary strength and improve the hot workability. However, excessive addition leads to excessive precipitated borides which conversely impair the hot workability, so the upper limit is made 0.0040%.

The lean duplex stainless steel as set forth in (4) of the present invention has both the effects of Nb to suppress nitrides of the lean duplex stainless steel as set forth in (2) and the effects of improving the hot workability due to the addition of elements in the lean duplex stainless steel as set forth in (3).

Next, the reasons for limitation of the steel composition of the lean duplex stainless steel as set forth in (5) of the present invention will be explained. The lean duplex stainless steel as set forth in (5) of the present invention further contains Co.

Co is an element effective for raising the toughness and corrosion resistance of steel and is selectively added. If the content is less than 0.02%, the effect is small, while if this is included over 1.00%, since it is an expensive element, an effect commensurate with the cost cannot be exhibited. Therefore, the content when added is set as 0.02 to 1.00%.

The lean duplex stainless steel as set forth in (6) of the present invention further contains Nb and Co, while the lean duplex stainless steel as set forth in (7) of the present invention further contains Nb and one or more of Ca, Mg, REM, and B, and Co. These have the effects of the elements explained above.

Next, the reasons for limitation of the steel composition of the lean duplex stainless steel as set forth in (8) of the present invention will be explained. The lean duplex stainless steel as set forth in (8) of the present invention further contains Mg combined with Ti.

As explained above, Ti, even in extremely small amounts, ends up precipitating as nitrides, so in the present invention, the amount of addition of Ti is limited to 0.05% or less. However, if added together with Mg, it is possible to make very fine TiN precipitate at the solidification stage so as to refine the ferrite structure and improve the toughness. To obtain such an effect, then it is preferable to add Ti together with Mg. In this case, the preferable amount of Ti is 0.003 to 0.05%. Further, when making fine TiN precipitate in the solidification stage, in addition to addition together with Mg, as shown below, the product of the $f_N$, Ti content, and N content is considered.

That is, Ti, particularly in the present invention steels with high N contents, forms TiN which act as delta ferrite precipitation nuclei and refine the ferrite grain size and thereby improve the toughness. For the purpose, inclusion of 0.003% or more is preferable. On the other hand, if over 0.05% is included, as explained above, even with the smallest N content, coarse TiN is formed and impairs the toughness. For this reason, the preferable content, as explained above, is 0.003 to 0.05%.

Mg forms a solid solution in steel or is present as oxides such as MgO or $MgO.Al_2O_3$. This oxide is believed to act as the nuclei for precipitation of TiN. As the Mg content for stably refining the solidified structure, 0.0001% or more is preferable. On the other hand, if including a large amount, the hot workability is impaired. For this reason, 0.0050% is made the upper limit of the content.

The lower limit of the product of the $f_N$, Ti content, and N content, that is $f_N \times Ti \times N$, is determined by whether TiN can be made to precipitate before the precipitation of delta ferrite. "$f_N$" is a coefficient for correction of the concentration of N and satisfies the relationship of the formula <4> in accordance with the composition of the steel. The coefficients applied to the contents of the elements set in formula <4> are interaction assisting coefficients relating to the amount of activity of N cited from the Japan Society for the Promotion of Science, Steelmaking No. 19 Committee ed., "Recommended Equilibrium Values of Steelmaking Reactions" (published Nov. 1, 1984). However, in the present invention steels, the Nb content is extremely small, so the term for correction of N activity by Nb is ignored and the formula made the formula <4> considering the effect of the Cr, Ni, Cu, Mn, Mo, and Si contained in a duplex stainless steel. The inventors introduced Mg in 0.0001 to 0.0030% in duplex stainless steel with an amount of Ti of a small amount of a range of 0.05% or less and containing N in an amount of 0.1% or more and searched for conditions refining the solidified structure. As result, they discovered that the lower limit of $f_N \times Ti \times N$ is 0.00004. Therefore, they set the lower limit at 0.00004. On the other hand, both the size and amount of nonmetallic inclusions have an effect on the toughness of the steel. The inventors studied the effects of the amounts of Ti and N on the toughness of thick-gauge steel plate and as a result learned that the larger the Ti×N, the more the toughness is impaired, so set the product of the Ti content and N content, Ti×N, at 0.008 or less.

$$\log_{10} f_N = -0.046 \times Cr - 0.02 \times Mn - 0.011 \times Mo + 0.048 \times Si + 0.007 \times Ni + 0.009 \times Cu \quad <4>$$

In the above formulas, the element names indicate the contents (%).

Next, the reasons for limitation of the steel composition of the lean duplex stainless steel as set forth in (9) of the present invention will be explained. The lean duplex stainless steel as set forth in (9) of the present invention further contains one or more of Zr, Ta, W, and Sn.

Zr and Ta are elements which, by addition, suppress the detrimental effects of C and S on the corrosion resistance, but if excessively added, cause the toughness to drop and have other detrimental effects. Therefore, the contents are limited to Zr≤0.03% and Ta≤0.1%. W is an element which is selectively added to additionally raise the corrosion resistance of duplex stainless steel. Excessive addition invites an increase in the amount of ferrite, so 1.0% or less is added. Sn is an element which additionally improves the acid resistance. From the viewpoint of the hot workability, it can be added up to 0.1% as the upper limit. Note that the contents where the effects of Zr, Ta, and W become stable are respectively 0.003%, 0.01%, 0.05%, and 0.05%.

The lean duplex stainless steel material of the present invention can be produced by taking a cast slab or steel slab of a duplex stainless steel having a composition described in any of (1) to (9), reheating it at 1100 to 1250° C., hot rolling it at a final temperature of 700 to 1000° C., heat treating the hot rolled steel at 900 to 1100° C. (however, within a range not off from the evaluation described in the later mentioned (10) of the present invention) for a heating time enabling the characteristics of the base material to be secured in accordance with the plate thickness (for example, for a material with a plate thickness of 10 mm, 2 to 40 minutes), then cooling it.

Next, the lean duplex stainless steel according to (10) of the present invention will be explained.

As explained above, the steels having the composition of the present invention are superior in corrosion resistance and toughness of the steel material and the weld heat affected zone. From the viewpoint of obtaining sufficient corrosion resistance at the weld heat affected zone, it is preferable select suitable solubilization heat treatment conditions in accordance with the steel composition and then perform the treatment. By defining amounts of extract residues of the steel materials simulating the heat history at the time of welding for this, it is possible to efficiently evaluate the corrosion resistance of the weld heat affected zone and provide lean duplex stainless steels provided with stabler characteristics. Further, based on this, it is possible to reflect this for setting suitable solubilization heat treatment conditions.

The amounts of extract residues of Cr, V, Nb, and B correspond to the amounts of precipitation of the carbonitrides of these elements. The CRN value shown by formula <5> for the steel samples heat treated by the heat pattern of FIG. 1 shows the ratio of the chromium carbonitrides in the total amount of main carbonitrides in the steel materials after welding by the molar percentage. When the amount of extract residue of Cr exceeds 0.025%, a chromium depleted zone is formed to the extent of the Cr consumed for precipitation and causes a drop in the corrosion resistance. On the other hand, when the CRN value is less than 0.5, this shows that the V, Nb, B, etc. do not form solid solutions, but precipitate and have a detrimental effect on the HAZ toughness etc. By performing this series of experiments and analyses, it is possible to evaluate the corrosion resistance and toughness of the HAZ and clarify the suitable solubilization heat treatment conditions of the lean duplex stainless steel material of the present invention without running actual welding tests.

$$CRN=([Cr]/104)/\{([Cr]/104)+([V]/51)+([Nb]/93)+([B]/11)\} \quad <5>$$

where, [Cr], [V], [Nb], and [B] indicate amounts of extract residues of the respective elements (mass %).

The amounts of extract residues are obtained by electrolyzing steel in a nonaqueous solution (for example, 3% maleic acid+1% tetramethyl ammonium chloride+balance of methanol) (for example, by a 100 mv constant voltage) to dissolve the matrix and filtering using a filter (for example, 0.2 μm pore size) to extract the precipitates. After this, the precipitates are completely dissolved by acid and ionized and, for example, a high frequency inductively coupled plasma emission spectrometer (ICP) used to measure the amounts of extract residues of the different ingredients.

EXAMPLES

Below, examples will be explained.

Table 1, Table 2 (continuation 1 of Table 1), Table 3 (continuation 2 of Table 1), and Table 4 (continuation 3 of Table 1) show the chemical compositions of the test steels (Table 1 and Table 2 show invention examples, while Table 3 and Table 4 show comparative examples). Note that in addition to the ingredients described in Table 1 to Table 4, the balance consists of Fe and unavoidable impurity elements.

Further, the Ni-bal, Md30, and $f_N$ described in Table 2 and Table 4 respectively mean:

$$Md30=551-462\times(C+N)-9.2\times Si-8.1\times Mn-29\times(Ni+Cu)-13.7\times Cr-18.5\times Mo-68\times Nb \quad <1>$$

$$Ni\text{-}bal=(Ni+0.5Cu+0.5Mn+30C+30N)-1.1(Cr+1.5Si+Mo+W)+8.2 \quad <2>$$

$$\log_{10}f_N=-0.046\times Cr-0.02\times Mn-0.011\times Mo+0.048\times Si+0.007\times Ni+0.009\times Cu \quad <4>$$

Note that, the empty cells indicate no measurement. Further, the REM in the tables indicate lanthanide-type rare earth elements with a content of these elements combined. Each duplex stainless steel having these ingredients was smelted in a laboratory 50 kg vacuum induction furnace in an MgO crucible and cast to a flat steel ingot of a thickness of about 100 mm. From the main part of the steel ingot, a hot rolling material was obtained. This was heated at a 1180° C. temperature for 1 to 2 hours, then rolled under conditions of a final temperature of 950 to 850° C. to obtain hot rolled steel plate of 12 mm thickness×about 700 mm length. Note that the steel was spray cooled from the state of a steel material temperature right after rolling of 800° C. or more down to 200° C. or less. The final solubilization heat treatment was performed under conditions at 1050° C.×20 minutes, then water cooling. For Steels 1, 4, 12, and 13, the solubilization heat treatment temperature was changed from 900° C. to 1100° C. in increments of 50° C. to prepare samples.

Furthermore, each 12 mm thick plate produced above was subjected to a welding test as a base material. The steel plate was formed with a V-shaped groove of a bevel angle of 35° and a root face of 1 mm. A commercially available welding wire (diameter 4.0 mmϕ, JIS SUS329J3L duplex type) was used for submerged arc welding under welding conditions of a weld current: 520 to 570 A, arc current: 30 to 33V, weld speed: 30 to 33 cm/min to prepare a weld joint.

The steel plates and weld joints obtained above were evaluated for characteristics as explained below. The hot workability was evaluated by designating the length of the longest edge crack in about 700 mm of the rolled material as the "edge crack length" and comparing its magnitude. For the impact toughness of the steel plates (base materials), three JIS No. 4 V-notch Charpy test pieces were cut from the direction perpendicular to the rolling direction of each steel plate, V-notches were formed so that fracture would propagate in the rolling direction, impact tests were run by a maximum energy 500 J specification tester, and the impact values at −20° C. were measured. For the impact characteristics of the HAZ, V-notch test pieces were obtained similar to the base materials so that the notches were positioned at parts 1 mm away from the bonded parts of the HAZ of the weld joints, impact tests were run under the same conditions as the base materials, and the impact values at −20° C. were measured. For the austenite area percentage, cross-sections of the steel plates parallel to the rolling direction were buried in resin, polished to a mirror finish, electrolytically etched in a KOH aqueous solution, then observed by an optical microscope and subjected to image analysis to measure the ferrite area percentage. The remaining part was considered the austenite area percentage. Furthermore, to evaluate the corrosion resistance, test pieces were taken from the surface layers of the steel plates (base materials) and weld joints (including all of base material, HAZ, and weld metal), polished by #600 polishing, and measured for pitting potential as defined in JIS G 0577.

The results of the evaluation are shown in Table 5 and Table 6 (continuation 1 of Table 5).

In the present invention steels, excellent values were shown for all of the edge cracks of rolled materials, impact toughness of the base material and weld HAZ, and pitting potential.

Regarding the corrosion resistance of the HAZ, as shown in FIG. 2, in the range where the formula <3> of the Ni-bal and N is satisfied, the pitting potential exceeds 250 mV vs the saturated Ag/AgCl electrode potential and good characteristics are obtained. On the other hand, the Steels J, Q, c, h, and j having higher N than this were poor in the corrosion resistance. Further, Steel M with a small amount of V addition was also poor in corrosion resistance.

For the corrosion resistance of the base material, Steels A, E, G, j having excessive C, Mn, or S and Steels I and P having too low Cr and N have pitting potentials lower than 300 mV vs saturated Ag/AgCl electrode potential. For the HAZ corrosion resistance, in addition to steels with the poor base materials and the above-mentioned steels, in Steel D having an Mn of less than 2.0, precipitation of nitrides caused the corrosion resistance to drop.

For the base material toughness and HAZ toughness, this is correlated with 2Ni+Cu. In Steels i and j having a poor value less than 3.5, the impact value fell below 58.75 J/cm$^2$. Further, for the toughness of the base material, Steels C, G, L, O, a, b, and c having either of Si, S, V, Al, Zr, Ta, or W excessively added had poor values below 150 J/cm$^2$. Conversely, in Steel H having too small an Ni as well, the toughness was poor. Further, if Md30 is too large, the Steel e also is poor in toughness.

Furthermore, in Steels B and N having Si or Al which is too small, the deoxidation was poor, so a high O resulted the poor toughness due to the large amount of inclusions. Regarding the HAZ toughness, in addition to the steels having a poor base material toughness, in Steel D having an Mn of less than 2.0, precipitation of nitrides resulted in a low toughness.

For the hot workability, when either of P, S, Cu, or Sn was excessive, the edge cracks of the hot rolled plate became 20 mm or more (Steels F, G, K, and d). Further, addition of B, Ca, Mg, or REM (Steels 10 to 20 of Table 5) resulted in improvement and extremely smaller edge cracks, but excessive addition conversely caused the hot workability to drop (Steels T to W of Table 6).

For the austenite phase area percentage, in Steels J, c, and g having Ni-bal's below the range of conditions, the percentage became less than 40% and as a result the toughness and corrosion resistance fell. In particular, in Steels J and c, the Cr and W were too high, so the range of conditions of the Ni-bal could not be satisfied. On the other hand, in the Steel f having an Ni-bal above the range of conditions, the percentage became 70% or more and as a result the corrosion resistance fell.

Regarding Nb, in Steels 3 to 5, 20, and 21 having Nb added, the pitting potentials were higher compared with Steels 1, 2, 6 to 19, 24 to 34, 35, and 37 having Nb either not added or less than 0.02 or with Steel 36 having an Nb×N of less than 0.003. On the other hand, in Steel R having an amount of addition of Nb of over 0.15%, the toughness of the base material and the HAZ were poor, while in Steel S having an Nb alone satisfying the conditions, but having a value of Nb×N of over 0.015, poor toughness similarly occurred. Further, even in Steel 37 having no Mo added, the results were no different from steel containing Mo.

In the steels having Ti and Mg added together, in Steels 22 and 23 satisfying $f_N \times Ti \times N \geq 0.00004$ and $Ti \times N \leq 0.008$, the HAZ toughness was further improved, but in steels X and Y having Ti>0.05 or Ti×N>0.008, the base material toughness became poor.

Next, for Steels 1, 4, 12, and 13, materials changed in solubilization heat treatment temperature from 950 to 1100° C. were heat treated as shown in FIG. 1 and measured for amounts of extract residues.

3 grams of a sample with a surface polished by #500 polishing was electrolyzed in a nonaqueous solution (3% maleic acid+1% tetramethyl ammonium chloride+balance of methanol) (by a 100 mv constant voltage) to dissolve the matrix and filtered using a filter of a 0.2 μm pore size to extract the precipitates. After this, the precipitates were completely dissolved by acid and ionized and, for example, a high frequency inductively coupled plasma emission spectrometer (ICP) used to measure the amounts of extract residues of the different ingredients.

As a result, regarding Steel 1, by 950 and 1000° C. solubilization heat treatments, the amounts of extract residues of Cr were 0.025% or less, that is, good characteristics were obtained. On the other hand, in materials treated by 1050° C. and 1100° C. solubilization heat treatments, the amounts of extract residues of Cr were over 0.025%. The HAZ pitting potentials of the materials were poor. Regarding Steels 4 and 12, the 950 to 1050° C. materials were good, while the 1100° C. materials were poor. On the other hand, in Steel 13, in the case of the 1050° C. and 1100° C. solubilization heat treatment materials, the CRN was 0.5 or less. This material therefore had a poor HAZ toughness.

As will be understood from the above examples, it became clear that according to the present invention, lean type duplex stainless steels with excellent corrosion resistance and toughness of the weld zones can be obtained.

INDUSTRIAL APPLICABILITY

According to the present invention, it is possible to provide a lean type duplex stainless steel which is lower in alloy cost and stabler compared with an austenitic stainless steel wherein one of the big problems in that steel, that is, the drop in the corrosion resistance and toughness of a weld heat affected zone, can be kept down and as a result expansion into applications taking the place of austenitic stainless steel where the work efficiency of welding was an issue can be promoted. The contribution to industry is extremely great.

TABLE 1

| Steel | | C | Si | Mn | P | S | Ni | Cr | Mo | Cu | V | Al | N | Nb | Co | O | Ca |
|---|---|---|---|---|---|---|---|---|---|---|---|---|---|---|---|---|---|
| 1 | Inv. | 0.011 | 0.75 | 2.88 | 0.022 | 0.0011 | 2.47 | 20.15 | 0.14 | 1.07 | 0.094 | 0.015 | 0.156 | | | 0.0027 | |
| 2 | ex. | 0.028 | 0.45 | 2.22 | 0.008 | 0.0011 | 1.71 | 20.81 | 0.22 | 1.85 | 0.333 | 0.022 | 0.132 | | | 0.0025 | |
| 3 | | 0.029 | 0.41 | 2.44 | 0.024 | 0.0005 | 1.98 | 21.18 | 0.35 | 1.44 | 0.211 | 0.022 | 0.178 | 0.025 | | 0.0035 | |
| 4 | | 0.033 | 0.55 | 2.77 | 0.023 | 0.0011 | 2.55 | 21.98 | 0.07 | 1.82 | 0.111 | 0.025 | 0.155 | 0.046 | | 0.0031 | |
| 5 | | 0.025 | 0.31 | 2.51 | 0.021 | 0.0007 | 2.44 | 21.78 | 0.33 | 1.51 | 0.055 | 0.018 | 0.140 | 0.105 | | 0.0025 | |
| 6 | | 0.009 | 0.55 | 2.44 | 0.018 | 0.0009 | 2.45 | 20.75 | 0.26 | 1.78 | 0.252 | 0.024 | 0.163 | | | 0.0033 | 0.0021 |
| 7 | | 0.023 | 0.44 | 2.48 | 0.026 | 0.0015 | 2.15 | 21.16 | 0.31 | 1.76 | 0.201 | 0.008 | 0.188 | | | 0.0028 | 0.0009 |
| 8 | | 0.045 | 0.72 | 2.64 | 0.019 | 0.0012 | 1.65 | 21.55 | 0.35 | 2.44 | 0.082 | 0.016 | 0.198 | | | 0.0032 | |
| 9 | | 0.032 | 0.32 | 2.66 | 0.016 | 0.0008 | 1.67 | 20.73 | 0.15 | 1.35 | 0.099 | 0.024 | 0.155 | | | 0.0023 | |
| 10 | | 0.027 | 0.15 | 2.15 | 0.022 | 0.0004 | 1.78 | 20.55 | 0.44 | 1.82 | 0.149 | 0.012 | 0.141 | | | 0.0065 | |
| 11 | | 0.035 | 0.58 | 2.85 | 0.011 | 0.0005 | 1.97 | 20.82 | 0.13 | 1.77 | 0.172 | 0.013 | 0.169 | | | 0.0044 | |
| 12 | | 0.031 | 0.45 | 2.22 | 0.035 | 0.0025 | 3.66 | 22.33 | 0.71 | 1.22 | 0.088 | 0.026 | 0.175 | | | 0.0028 | |
| 13 | | 0.018 | 0.64 | 2.33 | 0.014 | 0.0013 | 1.26 | 19.53 | 0.22 | 1.79 | 0.444 | 0.019 | 0.173 | | | 0.0039 | |
| 14 | | 0.033 | 0.72 | 2.38 | 0.013 | 0.0011 | 2.21 | 21.14 | 0.22 | 1.46 | 0.205 | 0.017 | 0.175 | | | 0.0036 | 0.0015 |
| 15 | | 0.028 | 0.49 | 2.71 | 0.021 | 0.0018 | 1.94 | 20.68 | 0.24 | 1.25 | 0.093 | 0.005 | 0.153 | | | 0.0042 | 0.0007 |
| 16 | | 0.026 | 0.61 | 2.22 | 0.028 | 0.0012 | 1.71 | 20.22 | 0.25 | 1.52 | 0.121 | 0.019 | 0.175 | | | 0.0031 | 0.0009 |
| 17 | | 0.025 | 0.44 | 2.22 | 0.022 | 0.0016 | 1.71 | 20.56 | 0.29 | 1.23 | 0.133 | 0.023 | 0.165 | | 0.38 | 0.0023 | |
| 18 | | 0.022 | 0.35 | 2.31 | 0.028 | 0.0005 | 1.55 | 20.44 | 0.11 | 1.21 | 0.105 | 0.011 | 0.222 | | 0.25 | 0.0033 | |
| 19 | | 0.017 | 0.82 | 2.67 | 0.018 | 0.0016 | 1.88 | 19.99 | 0.15 | 1.05 | 0.141 | 0.009 | 0.185 | | 0.05 | 0.0041 | 0.0031 |
| 20 | | 0.031 | 0.64 | 2.23 | 0.025 | 0.0008 | 2.97 | 21.11 | 0.34 | 1.24 | 0.145 | 0.016 | 0.185 | 0.055 | 0.25 | 0.0033 | 0.0020 |
| 21 | | 0.025 | 0.55 | 2.51 | 0.015 | 0.0005 | 2.05 | 20.52 | 0.35 | 1.55 | 0.075 | 0.025 | 0.185 | 0.041 | 0.09 | 0.0034 | |
| 22 | | 0.037 | 0.41 | 2.72 | 0.023 | 0.0009 | 2.11 | 21.35 | 0.38 | 2.22 | 0.313 | 0.016 | 0.152 | | | 0.0038 | |
| 23 | | 0.028 | 0.42 | 2.64 | 0.023 | 0.0008 | 1.91 | 21.22 | 0.41 | 1.23 | 0.063 | 0.022 | 0.159 | | | 0.0028 | |
| 24 | | 0.034 | 0.33 | 2.81 | 0.025 | 0.0011 | 1.68 | 21.64 | 0.31 | 1.85 | 0.101 | 0.036 | 0.181 | | | 0.0031 | |
| 25 | | 0.025 | 0.64 | 2.23 | 0.023 | 0.0013 | 1.84 | 20.76 | 0.18 | 1.94 | 0.146 | 0.016 | 0.192 | | | 0.0022 | |

TABLE 1-continued

| Steel | C | Si | Mn | P | S | Ni | Cr | Mo | Cu | V | Al | N | Nb | Co | O | Ca |
|---|---|---|---|---|---|---|---|---|---|---|---|---|---|---|---|---|
| 26 | 0.021 | 0.58 | 3.33 | 0.021 | 0.0015 | 2.67 | 21.66 | 0.29 | 0.82 | 0.089 | 0.028 | 0.188 | | | 0.0039 | |
| 27 | 0.024 | 0.39 | 2.25 | 0.014 | 0.0004 | 1.33 | 20.44 | 0.31 | 1.95 | 0.077 | 0.017 | 0.182 | | | 0.0019 | |
| 28 | 0.031 | 1.12 | 2.64 | 0.022 | 0.0017 | 2.45 | 19.66 | 0.35 | 1.33 | 0.222 | 0.024 | 0.175 | | | 0.0045 | |
| 29 | 0.036 | 0.89 | 2.66 | 0.009 | 0.0007 | 1.88 | 20.22 | 0.16 | 1.76 | 0.066 | 0.005 | 0.139 | | | 0.0009 | |
| 30 | 0.028 | 0.67 | 2.51 | 0.019 | 0.0015 | 1.88 | 20.78 | 0.37 | 1.91 | 0.088 | 0.009 | 0.172 | | | 0.0033 | |
| 31 | 0.014 | 0.55 | 2.35 | 0.025 | 0.0012 | 1.99 | 20.45 | 0.42 | 1.88 | 0.178 | 0.024 | 0.148 | | | 0.0042 | |
| 32 | 0.023 | 0.77 | 2.85 | 0.015 | 0.0007 | 1.53 | 20.35 | 0.12 | 1.11 | 0.192 | 0.021 | 0.181 | | | 0.0037 | |
| 33 | 0.033 | 0.55 | 2.71 | 0.027 | 0.0009 | 3.38 | 22.58 | 0.19 | 1.66 | 0.134 | 0.023 | 0.195 | | | 0.0041 | |
| 34 | 0.029 | 0.44 | 2.88 | 0.024 | 0.0007 | 2.51 | 21.45 | 0.41 | 1.81 | 0.065 | 0.015 | 0.133 | | | 0.0041 | |
| 35 | 0.033 | 0.72 | 2.64 | 0.023 | 0.0014 | 1.88 | 20.55 | 0.28 | 1.05 | 0.071 | 0.024 | 0.222 | 0.014 | 0.25 | 0.0033 | 0.0020 |
| 36 | 0.037 | 0.32 | 2.77 | 0.004 | 0.0016 | 2.85 | 20.91 | 0.40 | 1.95 | 0.083 | 0.034 | 0.123 | 0.022 | 0.09 | 0.0034 | |
| 37 | 0.037 | 0.66 | 2.45 | 0.019 | 0.0009 | 2.22 | 21.01 | 0.02 | 0.31 | 0.081 | 0.008 | 0.164 | | | 0.0022 | |

TABLE 2

(continuation 1 of Table 1)

| Steel | | Mg | REM | B | Ti | Zr | Ta | W | Sn | Md30 | Ni-bal |
|---|---|---|---|---|---|---|---|---|---|---|---|
| 1 | Inv. ex. | | | | 0.010 | | | | | 62.3 | −5.9 |
| 2 | | | | | | | | | | 62.6 | −7.1 |
| 3 | | | | | | | | | | 34.3 | −6.0 |
| 4 | | | | | 0.005 | | | | | 4.4 | −6.5 |
| 5 | | | | | | | | | | 4.2 | −5.9 |
| 6 | | | | | | | | | | 35.0 | −6.1 |
| 7 | | | | | 0.007 | | | | | 20.4 | −5.5 |
| 8 | | 0.0048 | | | | | | | | −9.6 | −5.6 |
| 9 | | 0.0011 | | | | | | | | 65.8 | −6.0 |
| 10 | | | 0.035 | | | | | | | 60.5 | −6.3 |
| 11 | | | 0.012 | | | | | | | 32.2 | −5.4 |
| 12 | | | | 0.0035 | | | | | | −26.9 | −6.3 |
| 13 | | | | 0.0006 | 0.004 | | | | | 77.9 | −5.5 |
| 14 | | 0.0022 | | | | | | | | 28.9 | −6.1 |
| 15 | | | 0.015 | | | | | | | 60.7 | −6.3 |
| 16 | | | | 0.0020 | | | | | | 59.2 | −5.7 |
| 17 | | | | | 0.011 | | | | | 68.9 | −6.3 |
| 18 | | | | | | | | | | 54.2 | −4.4 |
| 19 | | | | | | | | | | 66.9 | −5.5 |
| 20 | | | | 0.0033 | | | | | | 5.9 | −5.3 |
| 21 | | | | | | | | | | 33.8 | −5.3 |
| 22 | | 0.0010 | | | 0.003 | | | | | 12.8 | −6.1 |
| 23 | | 0.0025 | | | 0.015 | | | | | 50.0 | −6.8 |
| 24 | | | | | | 0.021 | | | | 21.3 | −6.0 |
| 25 | | | | | | 0.008 | | | | 29.4 | −5.5 |
| 26 | | | | | 0.006 | | 0.071 | | | 18.8 | −5.9 |
| 27 | | | | | | | 0.015 | | | 53.1 | −5.7 |
| 28 | | | | | | | | 0.88 | | 38.7 | −6.0 |
| 29 | | | | | | | | 0.09 | | 54.9 | −6.4 |
| 30 | | | | | | 0.015 | 0.035 | | | 30.7 | −6.1 |
| 31 | | | | | 0.008 | | 0.028 | 0.25 | | 51.9 | −7.0 |
| 32 | | | | | | | | | 0.05 | 69.0 | −6.0 |
| 33 | | | | | | | | 0.15 | 0.07 | −40.4 | −5.5 |
| 34 | | | | | 0.004 | | | | | 22.1 | −6.9 |
| 35 | | | | 0.0033 | | | | | | 32.5 | −4.5 |
| 36 | | | | | | | | | | 17.1 | −5.8 |
| 37 | | | | | | | | | | 70.6 | −6.4 |

| Steel | 0.37 + 0.03 × Ni-bal | 2Ni + Cu | Nb × N | $f_N$ | $f_N$ × Ti × N | Ti × N |
|---|---|---|---|---|---|---|
| 1 | 0.193 | 6.01 | 0 | 0.119 | 0.00019 | 0.0016 |
| 2 | 0.156 | 5.27 | 0 | 0.111 | 0 | 0 |
| 3 | 0.189 | 5.40 | 0.0045 | 0.105 | 0 | 0 |
| 4 | 0.176 | 6.92 | 0.0071 | 0.098 | 0.00008 | 0.0008 |
| 5 | 0.194 | 6.39 | 0.0147 | 0.098 | 0 | 0 |
| 6 | 0.187 | 6.68 | 0 | 0.113 | 0 | 0 |
| 7 | 0.204 | 6.06 | 0 | 0.106 | 0.00014 | 0.0013 |
| 8 | 0.202 | 5.74 | 0 | 0.105 | 0 | 0 |
| 9 | 0.190 | 4.69 | 0 | 0.107 | 0 | 0 |
| 10 | 0.180 | 5.38 | 0 | 0.110 | 0 | 0 |
| 11 | 0.208 | 5.71 | 0 | 0.110 | 0 | 0 |
| 12 | 0.180 | 8.54 | 0 | 0.095 | 0 | 0 |
| 13 | 0.204 | 4.31 | 0 | 0.128 | 0.00009 | 0.0007 |
| 14 | 0.187 | 5.88 | 0 | 0.110 | 0 | 0 |
| 15 | 0.182 | 5.13 | 0 | 0.110 | 0 | 0 |

TABLE 2-continued (continuation 1 of Table 1)

| | | | | | | |
|---|---|---|---|---|---|---|
| 16 | 0.199 | 4.94 | 0 | 0.120 | 0 | 0 |
| 17 | 0.180 | 4.65 | 0 | 0.112 | 0.00020 | 0.0018 |
| 18 | 0.239 | 4.31 | 0 | 0.112 | 0 | 0 |
| 19 | 0.205 | 4.81 | 0 | 0.122 | 0 | 0 |
| 20 | 0.212 | 7.18 | 0.0102 | 0.110 | 0 | 0 |
| 21 | 0.211 | 5.65 | 0.0076 | 0.114 | 0 | 0 |
| 22 | 0.186 | 6.44 | 0 | 0.103 | 0.00005 | 0.0005 |
| 23 | 0.165 | 5.05 | 0 | 0.103 | 0.00024 | 0.0024 |
| 24 | 0.189 | 5.21 | 0 | 0.098 | 0 | 0 |
| 25 | 0.206 | 5.62 | 0 | 0.115 | 0 | 0 |
| 26 | 0.193 | 6.16 | 0 | 0.097 | 0.00011 | 0.0011 |
| 27 | 0.200 | 4.61 | 0 | 0.114 | 0 | 0 |
| 28 | 0.190 | 6.23 | 0 | 0.132 | 0 | 0 |
| 29 | 0.177 | 5.52 | 0 | 0.122 | 0 | 0 |
| 30 | 0.188 | 5.67 | 0 | 0.113 | 0 | 0 |
| 31 | 0.161 | 5.86 | 0 | 0.116 | 0.00014 | 0.0012 |
| 32 | 0.191 | 4.17 | 0 | 0.116 | 0 | 0 |
| 33 | 0.205 | 8.42 | 0 | 0.093 | 0 | 0 |
| 34 | 0.164 | 6.83 | 0 | 0.101 | 0.00005 | 0.0005 |
| 35 | 0.234 | 4.81 | 0.0031 | 0.114 | 0 | 0 |
| 36 | 0.197 | 7.65 | 0.0027 | 0.107 | 0 | 0 |
| 37 | 0.178 | 4.75 | 0 | 0.108 | 0 | 0 |

Ni-bal = (Ni + 0.5Cu + 0.5Mn + 30C + 30N) − 1.1 (Cr + 1.5Si + Mo + W) + 8.2

Md30 = 551 − 462 (C + N) − 9.2Si − 8.1Mn − 29 (Ni + Cu) − 13.7Cr − 18.5Mo − 68Nb $\log_{10}f = -0.046Cr - 0.02Mn - 0.011\ Mo + 0.048Si + 0.007Ni + 0.009Cu$

TABLE 3

(continuation 2 of Table 1)

| Steel | | C | Si | Mn | P | S | Ni | Cr | Mo | Cu |
|---|---|---|---|---|---|---|---|---|---|---|
| A | Comp. ex. | 0.068 | 0.72 | 2.33 | 0.022 | 0.0005 | 1.44 | 20.87 | 0.33 | 1.82 |
| B | | 0.033 | 0.06 | 2.43 | 0.021 | 0.0044 | 1.71 | 21.23 | 0.38 | 1.34 |
| C | | 0.038 | 1.71 | 3.55 | 0.022 | 0.0009 | 2.22 | 20.11 | 0.41 | 1.64 |
| D | | 0.028 | 0.82 | 1.71 | 0.019 | 0.0012 | 1.67 | 20.08 | 0.16 | 1.58 |
| E | | 0.027 | 0.65 | 4.22 | 0.017 | 0.0011 | 1.99 | 21.89 | 0.29 | 1.54 |
| F | | 0.031 | 0.53 | 3.33 | 0.069 | 0.0006 | 2.82 | 22.64 | 0.22 | 1.85 |
| G | | 0.036 | 0.33 | 2.66 | 0.038 | 0.0062 | 2.22 | 21.54 | 0.24 | 1.34 |
| H | | 0.044 | 0.22 | 2.71 | 0.029 | 0.0016 | 0.78 | 20.66 | 0.18 | 1.98 |
| I | | 0.023 | 0.81 | 2.31 | 0.015 | 0.0008 | 1.58 | 18.46 | 0.23 | 1.55 |
| J | | 0.029 | 0.49 | 2.55 | 0.022 | 0.0015 | 2.45 | 23.19 | 0.28 | 1.91 |
| K | | 0.053 | 0.82 | 2.19 | 0.028 | 0.0011 | 1.65 | 21.31 | 0.36 | 3.31 |
| L | | 0.031 | 0.32 | 3.13 | 0.020 | 0.0011 | 1.45 | 19.45 | 0.33 | 1.99 |
| M | | 0.022 | 0.44 | 2.22 | 0.011 | 0.0033 | 2.01 | 21.57 | 0.08 | 2.22 |
| N | | 0.038 | 0.36 | 2.83 | 0.021 | 0.0009 | 2.44 | 22.05 | 0.36 | 1.34 |
| O | | 0.031 | 0.13 | 2.15 | 0.020 | 0.0007 | 1.97 | 21.53 | 0.31 | 1.58 |
| P | | 0.030 | 0.23 | 2.86 | 0.019 | 0.0004 | 3.11 | 20.51 | 0.15 | 2.44 |
| Q | | 0.020 | 0.64 | 2.35 | 0.022 | 0.0005 | 1.55 | 20.75 | 0.42 | 1.44 |
| R | | 0.028 | 0.35 | 2.55 | 0.025 | 0.0012 | 1.82 | 20.25 | 0.39 | 1.81 |
| S | | 0.034 | 0.61 | 2.22 | 0.029 | 0.0014 | 2.04 | 20.55 | 0.22 | 0.82 |
| T | | 0.022 | 0.31 | 2.51 | 0.021 | 0.0041 | 1.88 | 21.25 | 0.22 | 1.75 |
| U | | 0.038 | 0.65 | 2.42 | 0.026 | 0.0016 | 2.55 | 21.69 | 0.26 | 1.58 |
| V | | 0.044 | 0.42 | 2.45 | 0.021 | 0.0019 | 1.66 | 21.11 | 0.23 | 1.66 |
| W | | 0.024 | 0.52 | 2.91 | 0.028 | 0.0018 | 1.64 | 20.84 | 0.15 | 1.34 |
| X | | 0.022 | 0.45 | 2.33 | 0.021 | 0.0009 | 2.31 | 21.03 | 0.22 | 1.64 |
| Y | | 0.038 | 0.26 | 2.08 | 0.024 | 0.0005 | 3.07 | 22.11 | 0.44 | 1.34 |
| a | | 0.031 | 0.62 | 2.63 | 0.024 | 0.0009 | 1.81 | 20.81 | 0.31 | 1.34 |
| b | | 0.024 | 0.23 | 2.45 | 0.027 | 0.0006 | 1.06 | 20.45 | 0.38 | 1.81 |
| c | | 0.038 | 0.55 | 2.22 | 0.018 | 0.0012 | 1.24 | 20.55 | 0.45 | 1.88 |
| d | | 0.031 | 0.64 | 2.23 | 0.025 | 0.0008 | 2.97 | 21.11 | 0.34 | 1.24 |
| e | | 0.015 | 0.23 | 2.15 | 0.027 | 0.0006 | 1.49 | 19.66 | 0.25 | 1.61 |
| f | | 0.035 | 0.35 | 2.12 | 0.024 | 0.0005 | 2.75 | 20.54 | 0.44 | 1.51 |
| g | | 0.028 | 1.21 | 2.51 | 0.029 | 0.0009 | 2.32 | 20.32 | 0.71 | 1.55 |
| h | | 0.047 | 0.44 | 2.11 | 0.029 | 0.0005 | 1.51 | 21.33 | 0.33 | 1.03 |
| i | | 0.029 | 0.35 | 3.23 | 0.022 | 0.0019 | 1.18 | 19.21 | 0.46 | 0.99 |
| j | | 0.025 | 0.55 | 4.92 | 0.022 | 0.0008 | 1.45 | 21.42 | 0.22 | 0.35 |

| Steel | V | Al | N | Nb | Co | O | Ca |
|---|---|---|---|---|---|---|---|
| A | 0.204 | 0.021 | 0.171 | | | 0.0031 | |
| B | 0.333 | 0.023 | 0.157 | | | 0.0086 | |
| C | 0.133 | 0.024 | 0.197 | | | 0.0033 | |
| D | 0.149 | 0.024 | 0.172 | | | 0.0038 | |
| E | 0.079 | 0.028 | 0.166 | | | 0.0029 | |

TABLE 3-continued (continuation 2 of Table 1)

| | | | | | | |
|---|---|---|---|---|---|---|
| F | 0.059 | 0.026 | 0.188 | | 0.0022 | |
| G | 0.165 | 0.021 | 0.164 | | 0.0045 | |
| H | 0.088 | 0.024 | 0.171 | | 0.0051 | |
| I | 0.111 | 0.008 | 0.155 | | 0.0031 | |
| J | 0.155 | 0.021 | 0.158 | | 0.0033 | |
| K | 0.288 | 0.027 | 0.187 | | 0.0038 | |
| L | 0.712 | 0.025 | 0.188 | | 0.0031 | |
| M | 0.022 | 0.025 | 0.166 | | 0.0022 | |
| N | 0.088 | 0.002 | 0.194 | | 0.0105 | |
| O | 0.093 | 0.056 | 0.178 | | 0.0031 | |
| P | 0.149 | 0.026 | 0.078 | | 0.0029 | |
| Q | 0.188 | 0.023 | 0.255 | | 0.0038 | |
| R | 0.222 | 0.021 | 0.122 | 0.165 | 0.0034 | |
| S | 0.277 | 0.020 | 0.231 | 0.071 | 0.0034 | |
| T | 0.156 | 0.022 | 0.195 | | 0.0022 | 0.0065 |
| U | 0.123 | 0.024 | 0.167 | | 0.0029 | |
| V | 0.088 | 0.025 | 0.181 | | 0.0065 | |
| W | 0.188 | 0.028 | 0.181 | | 0.0038 | |
| X | 0.366 | 0.026 | 0.184 | | 0.0033 | |
| Y | 0.144 | 0.019 | 0.197 | | 0.0031 | |
| a | 0.077 | 0.021 | 0.178 | | 0.0025 | |
| b | 0.126 | 0.026 | 0.193 | | 0.0027 | |
| c | 0.061 | 0.021 | 0.163 | | 0.0019 | |
| d | 0.145 | 0.016 | 0.185 | | 0.0031 | |
| e | 0.149 | 0.026 | 0.168 | | 0.0033 | |
| f | 0.245 | 0.019 | 0.220 | | 0.0031 | |
| g | 0.088 | 0.025 | 0.111 | | 0.0044 | |
| h | 0.111 | 0.033 | 0.177 | | 0.0061 | |
| i | 0.588 | 0.025 | 0.212 | | 0.0052 | |
| j | 0.077 | 0.022 | 0.222 | | 0.0028 | |

* Underlines show outside scope of present invention.

TABLE 4

(continuation 3 of Table 1)

| Steel | | Mg | REM | B | Ti | Zr | Ta | W | Sn | Md30 | Ni-bal |
|---|---|---|---|---|---|---|---|---|---|---|---|
| A | Comp. ex. | | | | | | | | | 28.5 | −5.6 |
| B | | | | | | | | | | 56.7 | −6.4 |
| C | | | | | 0.032 | | | | | 2.9 | −5.3 |
| D | | | | | | | | | | 64.9 | −6.1 |
| E | | | | | | | | | | 14.0 | −6.6 |
| F | | | | | 0.011 | | | | | −31.7 | −5.8 |
| G | | | | | | | | | | 31.2 | −6.1 |
| H | | | | | | | | | | 61.3 | −5.5 |
| I | | | | | | | | | | 94.7 | −4.8 |
| J | | | | | 0.007 | | | | | −9.9 | −8.1 |
| K | | | | | | | | | | −27.6 | −5.4 |
| L | | | | | | | | | | 49.2 | −3.5 |
| M | | | | | | | | | | 22.5 | −6.5 |
| N | | | | | | | | | | −0.8 | −5.6 |
| O | | | | | 0.006 | | | | | 32.2 | −5.9 |
| P | | | | | | | | | | 31.1 | −5.9 |
| Q | | | | | | | | | | 20.3 | −4.4 |
| R | | | | | | | | | | 56.7 | −6.6 |
| S | | | | | 0.003 | | | | | 31.6 | −4.1 |
| T | | | | | | | | | | 27.1 | −5.4 |
| U | | 0.0072 | | | | | | | | 9.0 | −6.3 |
| V | | | 0.058 | | | | | | | 33.6 | −5.5 |
| W | | | | 0.0065 | | | | | | 53.2 | −5.8 |
| X | | 0.0022 | | | 0.061 | | | | | 26.1 | −5.4 |
| Y | | 0.0031 | | | 0.045 | | | | | −15.7 | −5.2 |
| a | | | | | | 0.042 | | | | 45.3 | −6.0 |
| b | | | | | | | 0.121 | | | 58.4 | −5.4 |
| c | | | | | | | | 1.58 | | 54.8 | −8.2 |
| d | | | | | | | | | 0.18 | 9.7 | −5.3 |
| e | | | | | 0.006 | | | | | 81.3 | −5.2 |
| f | | | | | | | | | | −0.3 | −3.2 |
| g | | | | | | | | | | 51.6 | −8.4 |
| h | | | | | | | | | | 54.4 | −6.6 |
| i | | | | | 0.004 | | | | | 75.7 | −3.5 |
| J | | | | | | | | | | 42.3 | −5.0 |

TABLE 4-continued (continuation 3 of Table 1)

| Steel | 0.37 + 0.03 × Ni-bal | 2Ni + Cu | Nb × N | $f_N$ | $f_N$ × Ti × N | Ti × N |
|---|---|---|---|---|---|---|
| A | 0.201 | 4.70 | 0 | 0.112 | 0 | 0 |
| B | 0.179 | 4.76 | 0 | 0.099 | 0 | 0 |
| C | 0.210 | 6.08 | 0 | 0.129 | 0.00082 | 0.0063 |
| D | 0.187 | 4.92 | 0 | 0.128 | 0 | 0 |
| E | 0.172 | 5.52 | 0 | 0.092 | 0 | 0 |
| F | 0.195 | 7.49 | 0 | 0.089 | 0.00018 | 0.0021 |
| G | 0.188 | 5.78 | 0 | 0.099 | 0 | 0 |
| H | 0.205 | 3.54 | 0 | 0.106 | 0 | 0 |
| I | 0.225 | 4.71 | 0 | 0.147 | 0 | 0 |
| J | 0.126 | 6.81 | 0 | 0.087 | 0.00010 | 0.0011 |
| K | 0.208 | 6.61 | 0 | 0.113 | 0 | 0 |
| L | 0.265 | 4.89 | 0 | 0.121 | 0 | 0 |
| M | 0.176 | 6.24 | 0 | 0.104 | 0 | 0 |
| N | 0.203 | 6.22 | 0 | 0.094 | 0 | 0 |
| O | 0.192 | 5.52 | 0 | 0.099 | 0.00011 | 0.0011 |
| P | 0.193 | 8.66 | 0 | 0.113 | 0 | 0 |
| Q | 0.237 | 4.54 | 0 | 0.112 | 0 | 0 |
| R | 0.173 | 5.45 | 0.0201 | 0.115 | 0 | 0 |
| S | 0.246 | 4.90 | 0.0164 | 0.115 | 0.00008 | 0.0007 |
| T | 0.208 | 5.51 | 0 | 0.103 | 0 | 0 |
| U | 0.180 | 6.68 | 0 | 0.103 | 0 | 0 |
| V | 0.205 | 4.98 | 0 | 0.106 | 0 | 0 |
| W | 0.195 | 4.62 | 0 | 0.107 | 0 | 0 |
| X | 0.207 | 6.26 | 0 | 0.109 | 0.00122 | 0.0112 |
| Y | 0.214 | 7.48 | 0 | 0.096 | 0.00085 | 0.0089 |
| a | 0.190 | 4.96 | 0 | 0.110 | 0 | 0 |
| b | 0.208 | 3.93 | 0 | 0.110 | 0 | 0 |
| c | 0.123 | 4.36 | 0 | 0.114 | 0 | 0 |
| d | 0.212 | 7.18 | 0 | 0.110 | 0 | 0 |
| e | 0.213 | 4.59 | 0 | 0.122 | 0.00012 | 0.0010 |
| f | 0.273 | 7.01 | 0 | 0.114 | 0 | 0 |
| g | 0.118 | 6.19 | 0 | 0.125 | 0 | 0 |
| h | 0.173 | 4.05 | 0 | 0.103 | 0 | 0 |
| i | 0.265 | 3.35 | 0 | 0.120 | 0.00010 | 0.0008 |
| J | 0.220 | 3.25 | 0 | 0.090 | 0 | 0 |

Ni-bal = (Ni + 0.5Cu + 0.5Mn + 30C + 30N) − 1.1 (Cr + 1.5Si + Mo + W) + 8.2

M30 = 551 − 462 (C + N) − 9.2Si − 8.1Mn − 29 (Ni + Cu) − 13.7Cr − 18.5Mo − 68Nb $\log_{10} f = -0.046Cr - 0.02Mn - 0.011Mo + 0.048Si + 0.007Ni + 0.009Cu$

* Underlines show outside scope of present invention.

TABLE 5

| Steel | Edge cracking (mm) | Heat treat. temp. (° C.) | Austenite phase area % (%) | [After heat treat. test] Cr extract residue (%) | CRN | Base material pitting potential Vc' 100 (mV vs sat. Ag/AgCl) | Weld HAZ pitting potential Vc' 100 (mV vs sat. Ag/AgCl) | Base material impact $vE_{-20}$ (J/cm$^2$) | HAZ impact $vE_{-20}$ (J/cm$^2$) | Remarks |
|---|---|---|---|---|---|---|---|---|---|---|
| 1 | 7 | 1000 | 56 | 0.015 | 0.82 | 319 | 296 | 310 | 150 | Inv. ex. |
| | | 950 | 55 | 0.013 | 0.83 | 312 | 299 | 323 | 166 | " |
| | | 1050 | 59 | 0.029 | 0.78 | 308 | 220 | 305 | 102 | Comp. ex. |
| | | 1100 | 61 | 0.039 | 0.75 | 306 | 195 | 302 | 98 | " |
| 2 | 8 | 1000 | 42 | | | 323 | 280 | 251 | 121 | Inv. ex. |
| 3 | 8 | 1000 | 52 | | | 467 | 398 | 282 | 113 | " |
| 4 | 7 | 1000 | 52 | 0.009 | 0.60 | 423 | 349 | 375 | 172 | " |
| | | 950 | 56 | 0.006 | 0.61 | 422 | 410 | 405 | 199 | " |
| | | 1050 | 51 | 0.020 | 0.59 | 429 | 335 | 370 | 105 | " |
| | | 1100 | 48 | 0.029 | 0.56 | 415 | 238 | 335 | 75 | Comp. ex. |
| 5 | 8 | 1000 | 57 | | | 515 | 415 | 288 | 129 | Inv. ex. |
| 6 | 1 | 1000 | 55 | | | 382 | 296 | 361 | 164 | " |
| 7 | 4 | 1000 | 59 | | | 449 | 395 | 305 | 145 | " |
| 8 | 9 | 1000 | 63 | | | 452 | 362 | 298 | 125 | " |
| 9 | 4 | 1000 | 51 | | | 331 | 276 | 215 | 84 | " |
| 10 | 3 | 1000 | 51 | | | 367 | 326 | 263 | 111 | " |
| 11 | 3 | 1000 | 59 | | | 377 | 351 | 285 | 121 | " |
| 12 | 14 | 1000 | 58 | 0.012 | 0.77 | 539 | 442 | 405 | 173 | " |
| | | 950 | 62 | 0.009 | 0.79 | 538 | 444 | 415 | 170 | " |
| | | 1050 | 56 | 0.023 | 0.75 | 528 | 378 | 400 | 122 | " |
| | | 1100 | 53 | 0.035 | 0.73 | 499 | 239 | 393 | 88 | Comp. ex. |

TABLE 5-continued

| Steel | Edge cracking (mm) | Heat treat. temp. (° C.) | Austenite phase area % (%) | [After heat treat. test] Cr extract residue (%) | CRN | Base material pitting potential Vc' 100 (mV vs sat. Ag/AgCl) | Weld HAZ pitting potential Vc' 100 (mV vs sat. Ag/AgCl) | Base material impact $vE_{-20}$ ($J/cm^2$) | HAZ impact $vE_{-20}$ ($J/cm^2$) | Remarks |
|---|---|---|---|---|---|---|---|---|---|---|
| 13 | 5 | 1000 | 54 | 0.013 | 0.53 | 342 | 291 | 191 | 91 | Inv. ex. |
| | | 950 | 57 | 0.009 | 0.56 | 388 | 380 | 200 | 93 | " |
| | | 1050 | 51 | 0.015 | 0.46 | 380 | 375 | 189 | 55 | Comp. ex. |
| | | 1100 | 49 | 0.017 | 0.43 | 376 | 355 | 188 | 50 | " |
| 14 | 1 | 1000 | 55 | | | 408 | 347 | 287 | 123 | Inv. ex. |
| 15 | 2 | 1000 | 50 | | | 334 | 262 | 261 | 121 | " |
| 16 | 9 | 1000 | 58 | | | 396 | 337 | 243 | 101 | " |
| 17 | 6 | 1000 | 50 | | | 368 | 277 | 232 | 95 | " |
| 18 | 7 | 1000 | 67 | | | 473 | 384 | 214 | 90 | " |
| 19 | 9 | 1000 | 58 | | | 365 | 291 | 231 | 95 | " |
| 20 | 7 | 1000 | 66 | | | 534 | 490 | 379 | 165 | " |
| 21 | 6 | 1000 | 63 | | | 490 | 449 | 400 | 185 | " |
| 22 | 11 | 1000 | 52 | | | 388 | 336 | 397 | 184 | " |
| 23 | 1 | 1000 | 45 | | | 367 | 265 | 392 | 171 | " |
| 24 | 8 | 1000 | 52 | | | 420 | 347 | 213 | 74 | " |
| 25 | 8 | 1000 | 63 | | | 446 | 343 | 274 | 115 | " |
| 26 | 9 | 1000 | 52 | | | 404 | 329 | 311 | 122 | " |
| 27 | 8 | 1000 | 58 | | | 420 | 360 | 210 | 85 | " |
| 28 | 10 | 1000 | 59 | | | 372 | 287 | 262 | 121 | " |
| 29 | 8 | 1000 | 54 | | | 308 | 259 | 286 | 138 | " |
| 30 | 9 | 1000 | 57 | | | 414 | 320 | 282 | 111 | " |
| 31 | 8 | 1000 | 48 | | | 347 | 261 | 303 | 124 | " |
| 32 | 11 | 1000 | 50 | | | 334 | 268 | 186 | 82 | " |
| 33 | 10 | 1000 | 64 | | | 509 | 407 | 425 | 188 | " |
| 34 | 8 | 1000 | 49 | | | 351 | 278 | 401 | 186 | " |
| 35 | 7 | 1000 | 67 | | | 490 | 424 | 231 | 86 | " |
| 36 | 6 | 1000 | 61 | | | 369 | 336 | 400 | 203 | " |
| 37 | 9 | 1000 | 48 | | | 388 | 326 | 312 | 135 | " |

* Underlines show outside scope of present invention.

TABLE 6

(continuation of Table 5)

| Steel | Edge cracking (mm) | Heat treat. temp. (° C.) | Austenite phase area % (%) | [After heat treat. test] Cr extract residue (%) | CRN | Base material pitting potential Vc' 100 (mV vs sat. Ag/AgCl) | Weld HAZ pitting potential Vc' 100 (mV vs sat. Ag/AgCl) | Base material impact $vE_{-20}$ ($J/cm^2$) | HAZ impact $vE_{-20}$ ($J/cm^2$) | Remarks |
|---|---|---|---|---|---|---|---|---|---|---|
| A | 6 | 1000 | 59 | | | 275 | 170 | 222 | 109 | Comp. ex. |
| B | 13 | 1000 | 43 | | | 361 | 290 | 139 | 43 | " |
| C | 7 | 1000 | 67 | | | 420 | 329 | 141 | 43 | " |
| D | 5 | 1000 | 58 | | | 394 | 228 | 226 | 54 | " |
| E | 6 | 1000 | 43 | | | 255 | 185 | 269 | 109 | " |
| F | 25 | 1000 | 58 | | | 458 | 363 | 415 | 194 | " |
| G | 43 | 1000 | 51 | | | 237 | 181 | 119 | 44 | " |
| H | 8 | 1000 | 54 | | | 324 | 288 | 133 | 48 | " |
| I | 5 | 1000 | 68 | | | 285 | 227 | 211 | 118 | " |
| J | 7 | 1000 | 36 | | | 397 | 224 | 359 | 142 | " |
| K | 25 | 1000 | 69 | | | 471 | 374 | 345 | 164 | " |
| L | 10 | 1000 | 65 | | | 383 | 379 | 138 | 47 | " |
| M | 13 | 1000 | 55 | | | 405 | 239 | 260 | 120 | " |
| N | 14 | 1000 | 57 | | | 478 | 402 | 115 | 38 | " |
| O | 12 | 1000 | 54 | | | 447 | 346 | 130 | 42 | " |
| P | 12 | 1000 | 61 | | | 262 | 201 | 405 | 228 | " |
| Q | 7 | 1000 | 67 | | | 467 | 227 | 142 | 41 | " |
| R | 8 | 1000 | 47 | | | 335 | 330 | 126 | 47 | " |
| S | 8 | 1000 | 68 | | | 512 | 412 | 128 | 42 | " |
| T | 29 | 1000 | 58 | | | 446 | 346 | 197 | 70 | " |
| U | 25 | 1000 | 55 | | | 426 | 325 | 352 | 156 | " |
| V | 30 | 1000 | 59 | | | 389 | 316 | 234 | 91 | " |

TABLE 6-continued (continuation of Table 5)

| Steel | Edge cracking (mm) | Heat treat. temp. (° C.) | Austenite phase area % (%) | [After heat treat. test] Cr extract residue (%) | CRN | Base material pitting potential Vc' 100 (mV vs sat. Ag/AgCl) | Weld HAZ pitting potential Vc' 100 (mV vs sat. Ag/AgCl) | Base material impact $vE_{-20}$ ($J/cm^2$) | HAZ impact $vE_{-20}$ ($J/cm^2$) | Remarks |
|---|---|---|---|---|---|---|---|---|---|---|
| W | 21 | 1000 | 51 | | | 358 | 299 | 221 | 79 | " |
| X | 11 | 1000 | 58 | | | 429 | 355 | 126 | 38 | " |
| Y | 9 | 1000 | 65 | | | 554 | 493 | 93 | 25 | " |
| a | 9 | 1000 | 54 | | | 398 | 300 | 140 | 50 | " |
| b | 12 | 1000 | 56 | | | 427 | 352 | 136 | 53 | " |
| c | 13 | 1000 | 37 | | | 335 | 194 | 141 | 42 | " |
| d | 29 | 1000 | 66 | | | 484 | 405 | 401 | 182 | " |
| e | 7 | 1000 | 60 | | | 374 | 319 | 139 | 56 | " |
| f | 24 | 1000 | 75 | | | 259 | 215 | 402 | 205 | " |
| g | 7 | 1000 | 35 | | | 229 | 152 | 260 | 99 | " |
| h | 8 | 1000 | 46 | | | 370 | 207 | 211 | 56 | " |
| i | 6 | 1000 | 61 | | | 400 | 392 | 127 | 54 | " |
| j | 7 | 1000 | 50 | | | 295 | 169 | 133 | 29 | " |
| | | | | | | | | | | (S32101) |

* Underlines show outside scope of present invention.

The invention claimed is:

1. A lean duplex stainless steel having corrosion resistance and toughness of a weld heat affected zone comprising, by mass %, C: 0.06% or less, Si: 0.1 to 1.5%, Mn: 2.0 to 4.0%, P: 0.05% or less, S: 0.005% or less, Cr: 19.0 to 23.0%, Ni: 1.0 to 4.0%, Mo: 1.0% or less, Cu: 0.1 to 3.0%, V: 0.05 to 0.5%, Al: 0.003 to 0.050%, O: 0.007% or less, N: 0.10 to 0.25%, and Ti: 0.05% or less, and having a balance of Fe and unavoidable impurities, wherein an Md30 value expressed by formula <1> is 80 or less, an Ni-bal expressed by formula <2> is −7.1 to −4, the Ni-bal and the N content satisfy formula <3>, the lean duplex stainless steel has an austenite phase area percentage of 40 to 70%, and the lean duplex stainless steel has a value of 2×Ni+Cu of 3.5 or more:

$$Md30=551-462\times(C+N)-9.2\times Si-8.1\times Mn-29\times(Ni+Cu)-13.7\times Cr-18.5\times Mo-68\times Nb \quad <1>;$$

$$Ni\text{-}bal=(Ni+0.5Mn+0.5Cu+30C+30N)-1.1(Cr+1.5Si+Mo+W)+8.2 \quad <2>;$$

$$N(\%)\leq 0.37+0.03\times(Ni\text{-}bal) \quad <3>;$$

wherein, in the above formulas, the element symbols represent the content of the elements in mass %.

2. The lean duplex stainless steel as set forth in claim 1, further comprising, by mass %, Nb: 0.02 to 0.15%, wherein the product of the Nb and N content in mass %, Nb×N, is 0.003 to 0.015.

3. The lean duplex stainless steel as set forth in claim 1, further comprising, by mass %, one or more of no more than 0.0050% Ca, no more than 0.0050% Mg, no more than 0.050% REM, and no more than 0.0040% B.

4. The lean duplex stainless steel as set forth in claim 1, further comprising, by mass %, Nb: 0.02 to 0.15%, wherein the product of the Nb and N content in mass %, Nb×N, is 0.003 to 0.015, and one or more of no more than 0.0050% Ca, no more than 0.0050% Mg, no more than 0.050% REM, and no more than 0.0040% B.

5. The lean duplex stainless steel as set forth in claim 1, further comprising, by mass %, Co: 0.02 to 1.00%.

6. The lean duplex stainless steel as set forth in claim 1, further comprising, by mass %, Nb: 0.02 to 0.15%, wherein the product of the Nb and N content in mass %, Nb×N, is 0.003 to 0.015, Co: 0.02 to 1.00%.

7. The lean duplex stainless steel as set forth in claim 1, further comprising, by mass %, Nb: 0.02 to 0.15%, wherein the product of the Nb and N content in mass %, Nb×N, is 0.003 to 0.015, Co: 0.02 to 1.00%, and one or more of no more than 0.0050% Ca, no more than 0.0050% Mg, no more than 0.050% REM, and no more than 0.0040% B.

8. The lean duplex stainless steel as set forth in claim 1, further comprising, by mass %, Mg: 0.0001 to 0.0050%, wherein a product of $f_N$, Ti content in mass %, and N content in mass %, $f_N$×Ti×N, is 0.00004 or more, and a product of Ti content and N content in mass %, Ti×N, is 0.008 or less:

wherein, $f_N$ is a value satisfying formula <4>:

$$\log_{10} f_N=-0.046\times Cr-0.02\times Mn-0.011\times Mo+0.048\times Si+0.007\times Ni+0.009\times Cu \quad <4>$$

wherein, in the above formula, the element symbols represent the content of the elements in mass %.

9. The lean duplex stainless steel as set forth in claim 1, further comprising, by mass %, one or more of Zr≤0.03%, Ta≤0.1%, W≤1.0%, and Sn≤0.1%.

10. The lean duplex stainless steel as set forth in claim 1, wherein following (i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN=([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

11. The lean duplex stainless steel as set forth in claim 2, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN=([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

12. The lean duplex stainless steel as set forth in claim 3, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN=([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

13. The lean duplex stainless steel as set forth in claim 4, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN=([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

14. The lean duplex stainless steel as set forth in claim 5, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN=([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

15. The lean duplex stainless steel as set forth in claim 6, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN=([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

16. The lean duplex stainless steel as set forth in claim 7, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN=([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

17. The lean duplex stainless steel as set forth in claim 8, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN=([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

18. The lean duplex stainless steel as set forth in claim 9, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN=([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

19. The lean duplex stainless steel as set forth in claim 1, further comprising, by mass %, Co: 0.02 to 1.00% and one or more of no more than 0.0050% Ca, no more than 0.0050% Mg, no more than 0.050% REM, and no more than 0.0040% B.

20. The lean duplex stainless steel as set forth in claim 1, further comprising, by mass %, Nb: 0.02 to 0.15%, wherein the product of the Nb and N content in mass %, Nb×N, is 0.003 to 0.015, and Mg: 0.0001 to 0.0050%, wherein a product of $f_N$, Ti content in mass %, and N content in mass %, $f_N \times Ti \times N$, is 0.00004 or more, and a product of Ti content and N content in mass %, Ti×N, is 0.008 or less:

wherein, $f_N$ is a value satisfying formula <4>:

$$\log_{10} f_N = -0.046 \times Cr - 0.02 \times Mn - 0.011 \times Mo + 0.048 \times Si + 0.007 \times Ni + 0.009 \times Cu \quad <4>$$

wherein, in the above formula, the element symbols represent the content of the elements in mass %.

21. The lean duplex stainless steel as set forth in claim 1, further comprising, by mass %, one or more of no more than 0.0050% Ca, no more than 0.050% REM, and no more than 0.0040% B, and Mg: 0.0001 to 0.0050%, wherein a product of $f_N$, Ti content in mass %, and N content in mass %, $f_N \times Ti \times N$, is 0.00004 or more, and a product of Ti content and N content in mass %, Ti×N, is 0.008 or less:

wherein, $f_N$ is a value satisfying formula <4>:

$$\log_{10} f_N = -0.046 \times Cr - 0.02 \times Mn - 0.011 \times Mo + 0.048 \times Si + 0.007 \times Ni + 0.009 \times Cu \quad <4>$$

wherein, in the above formula, the element symbols represent the content of the elements in mass %.

22. The lean duplex stainless steel as set forth in claim 1, further comprising, by mass %, Co: 0.02 to 1.00% and Mg: 0.0001 to 0.0050%, wherein a product of $f_N$, Ti content in mass %, and N content in mass %, $f_N \times Ti \times N$, is 0.00004 or more, and a product of Ti content and N content in mass %, Ti×N, is 0.008 or less:

wherein, $f_N$ is a value satisfying formula <4>:

$$\log_{10} f_N = -0.046 \times Cr - 0.02 \times Mn - 0.011 \times Mo + 0.048 \times Si + 0.007 \times Ni + 0.009 \times Cu \quad <4>$$

wherein, in the above formula, the element symbols represent the content of the elements in mass %.

23. The lean duplex stainless steel as set forth in claim 1, further comprising, by mass %, one or more of Zr≤0.03%, Ta≤0.1%, W≤1.0%, Sn≤0.1%, and Mg: 0.0001 to 0.0050%, wherein a product of $f_N$, Ti content in mass %, and N content in mass %, $f_N \times Ti \times N$, is 0.00004 or more, and a product of Ti content and N content in mass %, Ti×N, is 0.008 or less:

wherein, $f_N$ is a value satisfying formula <4>:

$$\log_{10} f_N = -0.046 \times Cr - 0.02 \times Mn - 0.011 \times Mo + 0.048 \times Si + 0.007 \times Ni + 0.009 \times Cu \quad <4>$$

wherein, in the above formula, the element symbols represent the content of the elements in mass %.

24. The lean duplex stainless steel as set forth in claim 19, further comprising, by mass %, Mg: 0.0001 to 0.0050%, wherein a product of $f_N$, Ti content in mass %, and N content in mass %, $f_N \times Ti \times N$, is 0.00004 or more, and a product of Ti content and N content in mass %, Ti×N, is 0.008 or less:

wherein, $f_N$ is a value satisfying formula <4>:

$$\log_{10} f_N = -0.046 \times Cr - 0.02 \times Mn - 0.011 \times Mo + 0.048 \times Si + 0.007 \times Ni + 0.009 \times Cu \quad <4>$$

wherein, in the above formula, the element symbols represent the content of the elements in mass %.

25. The lean duplex stainless steel as set forth in claim 19, further comprising, by mass %, one or more of Zr≤0.03%, Ta≤0.1%, W≤1.0%, and Sn≤0.1%.

26. The lean duplex stainless steel as set forth in claim 19, further comprising, by mass %, Nb: 0.02 to 0.15%, wherein the product of the Nb and N content in mass %, Nb×N, is 0.003 to 0.015, one or more of Zr≤0.03%, Ta≤0.1%, W≤1.0%, and Sn≤0.1%, and Mg: 0.0001 to 0.0050%, wherein a product of $f_N$, Ti content in mass %, and N content in mass %, $f_N \times Ti \times N$, is 0.00004 or more, and a product of Ti content and N content in mass %, Ti×N, is 0.008 or less:

wherein, $f_N$ is a value satisfying formula <4>:

$$\log_{10} f_N = -0.046 \times Cr - 0.02 \times Mn - 0.011 \times Mo + 0.048 \times Si + 0.007 \times Ni + 0.009 \times Cu \quad <4>$$

wherein, in the above formula, the element symbols represent the content of the elements in mass %.

27. The lean duplex stainless steel as set forth in claim 19, further comprising, by mass %, Nb: 0.02 to 0.15%, wherein the product of the Nb and N content in mass %, Nb×N, is 0.003 to 0.015 and Mg: 0.0001 to 0.0050%, wherein a product of $f_N$, Ti content in mass %, and N content in mass %, $f_N \times Ti \times N$, is 0.00004 or more, and a product of Ti content and N content in mass %, Ti×N, is 0.008 or less:

wherein, $f_N$ is a value satisfying formula <4>:

$$\log_{10} f_N = -0.046 \times Cr - 0.02 \times Mn - 0.011 \times Mo + 0.048 \times Si + 0.007 \times Ni + 0.009 \times Cu \quad <4>$$

wherein, in the above formula, the element symbols represent the content of the elements in mass %.

28. The lean duplex stainless steel as set forth in claim 19, further comprising, by mass %, Nb: 0.02 to 0.15%, wherein the product of the Nb and N content in mass %, Nb×N, is 0.003 to 0.015 and one or more of Zr≤0.03%, Ta≤0.1%, W≤1.0%, and Sn≤0.1%.

29. The lean duplex stainless steel as set forth in claim 19, further comprising, by mass %, one or more of Zr≤0.03%, Ta≤0.1%, W≤1.0%, and Sn≤0.1%, and Mg: 0.0001 to 0.0050%, wherein a product of $f_N$, Ti content in mass %, and N content in mass %, $f_N \times Ti \times N$, is 0.00004 or more, and a product of Ti content and N content in mass %, Ti×N, is 0.008 or less:

wherein, $f_N$ is a value satisfying formula <4>:

$$\log_{10} f_N = -0.046 \times Cr - 0.02 \times Mn - 0.011 \times Mo + 0.048 \times Si + 0.007 \times Ni + 0.009 \times Cu \quad <4>$$

wherein, in the above formula, the element symbols represent the content of the elements in mass %.

30. The lean duplex stainless steel as set forth in claim 19, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN = ([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

31. The lean duplex stainless steel as set forth in claim 24, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN = ([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

32. The lean duplex stainless steel as set forth in claim 25, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN=([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

33. The lean duplex stainless steel as set forth in claim 26, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN=([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

34. The lean duplex stainless steel as set forth in claim 27, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN=([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

35. The lean duplex stainless steel as set forth in claim 28, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN=([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

36. The lean duplex stainless steel as set forth in claim 29, wherein following:

(i) a temperature elevation from room temperature to 1300° C. in 15 seconds, (ii) retention at 1300° C. for 5 seconds, (iii) isothermal cooling from 1300° C. to 900° C. in 15 seconds, (iv) isothermal cooling from 900° C. to 400° C. in 135 seconds, and (v) rapid cooling from 400° C. to room temperature, simulating a heat history received by the steel at the time of welding, a Cr extract residue of the steel has a value of 0.025% or less and a CRN value, as determined in the following formula <5>, of 0.5 or more:

$$CRN=([Cr]/104)/\{([Cr]/104)+([V]/51)+([Nb]/93)+([B]/11)\} \quad <5>$$

where, [Cr], [V], [Nb], and [B] all express extract residue amounts of the elements in mass %.

37. The lean duplex stainless steel as set forth in claim 3, further comprising, by mass %, one or more of Zr≤0.03%, Ta≤0.1%, W≤1.0%, and Sn≤0.1%.

38. The lean duplex stainless steel as set forth in claim 5, further comprising, by mass %, one or more of Zr≤0.03%, Ta≤0.1%, W≤1.0%, and Sn≤0.1%.

39. The lean duplex stainless steel as set forth in claim 1, further comprising, by mass %, one or more selected from the group consisting of a) Nb: 0.02 to 0.15%, wherein the product of the Nb and N content in mass %, Nb×N, is 0.003 to 0.015%;

b) one or more of no more than 0.0050% Ca, no more than 0.0050% Mg, no more than 0.050% REM, and no more than 0.0040% B;

c) Co: 0.02 to 1.00%; and d) one or more of Zr≤0.03%, Ta≤0.1%, W≤1.0%, and Sn≤0.1%.

40. The lean duplex stainless steel as set forth in claim 1, wherein Ti is not added.

41. The lean duplex stainless steel as set forth in claim 39, wherein Ti is not added.

42. A lean duplex stainless steel having corrosion resistance and toughness of a weld heat affected zone comprising, by mass %, C: 0.06% or less, Si: 0.1 to 1.5%, Mn: 2.0 to 4.0%, P: 0.05% or less, S: 0.005% or less, Cr: 19.0 to 23.0%, Ni: 1.55 to 4.0%, Mo: 1.0% or less, Cu: 0.1 to 3.0%, V: 0.05 to 0.5%, Al: 0.003 to 0.050%, O: 0.007% or less, N: 0.10 to 0.25%, and Ti: 0.05% or less, and having a balance of Fe and unavoidable impurities, wherein an Md30 value expressed by formula <1> is 80 or less, an Ni-bal expressed by formula <2> is −7.1 to −4, the Ni-bal and the N content satisfy formula <3>, the lean duplex stainless steel has an austenite phase area percentage of 40 to 70%, and the lean duplex stainless steel has a value of 2×Ni+Cu of 3.5 or more:

$$Md30=551-462\times(C+N)-9.2\times Si-8.1\times Mn-29\times(Ni+Cu)-13.7\times Cr-18.5\times Mo-68\times Nb \quad <1>;$$

$$Ni\text{-}bal=(Ni+0.5Mn+0.5Cu+30C+30N)-1.1(Cr+1.5Si+Mo+W)+8.2 \quad <2>;$$

$$N(\%)\leq 0.37+0.03\times(Ni\text{-}bal) \quad <3>;$$

wherein, in the above formulas, the element symbols represent the content of the elements in mass %.

43. The lean duplex stainless steel as set forth in claim 42, wherein Ti is not added.

* * * * *